US008672823B2

(12) United States Patent
Parruca et al.

(10) Patent No.: US 8,672,823 B2
(45) Date of Patent: Mar. 18, 2014

(54) NAPKIN FOLDING DEVICE

(75) Inventors: Elio Parruca, Köln (DE); Christian Abt, Eislingen (DE)

(73) Assignee: Rofobox GmbH, Kornwestheim (DE)

( * ) Notice: Subject to any disclaimer, the term of this patent is extended or adjusted under 35 U.S.C. 154(b) by 400 days.

(21) Appl. No.: 12/997,636

(22) PCT Filed: Jun. 25, 2009

(86) PCT No.: PCT/EP2009/004596
§ 371 (c)(1),
(2), (4) Date: Dec. 13, 2010

(87) PCT Pub. No.: WO2009/156158
PCT Pub. Date: Dec. 30, 2009

(65) Prior Publication Data

US 2011/0130261 A1 Jun. 2, 2011

(30) Foreign Application Priority Data

Jun. 26, 2008 (DE) ..... 10 2008 031 811

(51) Int. Cl.
*B65H 45/12* (2006.01)

(52) U.S. Cl.
USPC ..... 493/416; 493/405; 493/436; 493/450; 493/455; 493/457

(58) Field of Classification Search
USPC ..... 493/405, 408–409, 416, 418, 422, 493/424–426, 436–438, 440, 450, 455, 457
See application file for complete search history.

(56) References Cited

U.S. PATENT DOCUMENTS

| | | | | |
|---|---|---|---|---|
| 1,371,349 | A | 3/1921 | Brownlow | |
| 2,025,246 | A | 12/1935 | Preston | |
| 2,056,903 | A | 10/1936 | Mayer | |
| 3,768,807 | A * | 10/1973 | Spengler | 271/190 |

(Continued)

FOREIGN PATENT DOCUMENTS

| | | |
|---|---|---|
| FR | 1240068 A | 7/1960 |
| FR | 2119525 A | 8/1972 |

(Continued)

OTHER PUBLICATIONS

International Preliminary Report on Patentability for corresponding International App. PCT/EP2009/004596 (with translation).

(Continued)

*Primary Examiner* — Christopher Harmon
(74) *Attorney, Agent, or Firm* — Jordan and Hamburg LLP

(57) ABSTRACT

A napkin folding device is provided having a folding unit provided for folding individual napkins, a storage unit provided for holding the folded napkins from the folding unit, a delivery unit provided for holding out unfolded napkins, and a transport unit provided for feeding the unfolded napkins from the delivery unit to the folding unit. The delivery unit has a magazine including at least two delivery levels.

4 Claims, 36 Drawing Sheets

(56) References Cited

U.S. PATENT DOCUMENTS

| | | | | |
|---|---|---|---|---|
| 4,349,185 | A * | 9/1982 | Small et al. | 270/32 |
| 4,865,579 | A * | 9/1989 | Kirby et al. | 493/458 |
| 4,979,728 | A * | 12/1990 | Shinotsuka | 271/99 |
| 5,079,867 | A * | 1/1992 | Kober et al. | 38/2 |
| 5,156,514 | A * | 10/1992 | Zah | 414/278 |
| 5,435,802 | A * | 7/1995 | Kober | 493/23 |
| 2003/0197322 | A1* | 10/2003 | Niedermeyer | 270/45 |
| 2005/0166549 | A1 | 8/2005 | Lavi | |
| 2006/0154792 | A1* | 7/2006 | Stefanoni | 493/349 |
| 2012/0329628 | A1* | 12/2012 | Abt et al. | 493/416 |

FOREIGN PATENT DOCUMENTS

| | | |
|---|---|---|
| GB | 545939 | 6/1942 |
| GB | 545939 A | 6/1942 |
| JP | 7275600 | 10/1995 |

OTHER PUBLICATIONS

Examination Report for corresponding German App. 10 2008 031 811.6 (with translation).

International Search Report for corresponding International App. PCT/EP2009/004596 (with translation).

* cited by examiner

Alternative 1

Alternative 2

Alternative 3

NAPKIN FOLDING DEVICE

BACKGROUND AND SUMMARY

The invention concerns a napkin folding device as well as components thereof.

There are known devices for the folding of cloths, such as towels. Patent specification U.S. Pat. No. 2,025,246, for example, describes a folding device equipped with a folding unit for the folding of individual towels, a storage unit for holding folded towels from the folding unit, a delivery unit for the holding out of unfolded towels and a transport unit for the feeding of the unfolded towels from the delivery unit to the folding unit. In the delivery unit the unfolded towels are held in a stack. A grip system of the transport unit removes individual towels one by one from this stack to feed them to the feeding unit.

From patent specification U.S. Pat. No. 1,371,349, a napkin folding device is known which comprises a folding unit for the folding of individual napkins, equipped with a storage unit for holding folded napkins from the folding unit. An individual unfolded napkin is manually fed to the folding unit. In the folding unit, the individual napkin is folded in a double walled housing body and from there fed to the storage unit by means of rollers.

From patent specification U.S. Pat. No. 4,865,579, a napkin folding device is known which comprises a folding unit for the folding of individual napkins. The folding unit contains multiple folding devices for multiple folding of an individual napkin, whereby the folding devices are employed one after another. Each folding device folds the individual napkin along a prescribed axis.

From patent specification US JP 07275600, a napkin folding device is known, the folding unit of which works in a zigzag to fold individual napkins. Here, the napkin is placed on a holding table with recesses. To fold in zigzag form, the napkin is pushed from the folding unit into the recesses.

It is desirable to specify a napkin folding device that provides for a significant improvement in the folding of napkins. Likewise, components for this device must be created.

The napkin folding device according to an aspect of the invention features a delivery unit that has a magazine for holding out unfolded napkins with at least two delivery levels. In this connection, the term "unit" designates an entire unit, which can consist of or comprise multiple individual units. In this way, it is possible to simply load the delivery unit with large quantities of unfolded napkins and to simply remove the napkins, which results in a significant savings of time in the folding of napkins. This also advantageously leads to a significant improvement in the folding of napkins, because the folding operation can proceed almost automatically. It requires far fewer manual activities, such as loading the delivery unit with unfolded napkins or removing folded napkins from the storage unit, inasmuch as these activities take place at greater intervals of time.

Advantageously, the delivery unit is located in at least one delivery level in a loading position and in at least one delivery level in a removal position. This way the loading of the delivery unit and the removal of an unfolded napkin for the subsequent folding operation can take place simultaneously, which results in a considerable savings of time.

Preferably, the delivery unit has a magazine that is run along a feed path in a circular direction so it can be filled with unfolded napkins. In an alternative embodiment, the delivery unit has a magazine that can rotate around a vertical axis and/or be driven along an axis so it can be filled with unfolded napkins. In this way, it is possible to load the delivery unit with large quantities of unfolded napkins, which results in a considerable savings of time in the folding of napkins. It is thus possible to operate the napkin folding device over a longer period of time without manual intervention.

Expediently, the magazine has multiple shelves disposed above each other, whereby each shelf is stored in guide rails in the delivery unit. In an alternative embodiment, the magazine has at least two units disposed side by side, each with multiple shelves disposed above each other. As a rule, a large stack of unfolded napkins will sag in the middle. Because the magazine, or the magazine units, has multiple shelves, which are each loaded with smaller stacks of napkins, the magazine can advantageously be loaded with large quantities of unfolded napkins without creating the danger of sagging in the napkin stacks.

In a further embodiment, in order to drive the magazine containing the guide rails and the shelves in the circular direction, the delivery unit has a first handling device, which drives the guide rails in the delivery unit, and a second handling device, which drives the shelves in the delivery unit. This yields a space-saving and secure alternative for driving the magazine in the delivery unit. The secure motion of the magazine makes the uninterrupted delivery of napkins to the folding unit possible. Preferably, the delivery unit is constructed in such a way that automatically after each cycle, for example, after provision and delivery of napkins to the folding unit, it places the napkin stack in such a way, for example, pushed upward, that the upper napkins remain always at the same height, and correct removal by means of a carrier framework or a similar system can be performed. The pushing up can be accomplished by means of a spring system, which is pushed down by the dead weight of the napkin stack and remains always taut. As each napkin is taken from the stack, the napkin stack is successively moved upward. The pushing up or placing can, however be carried out with other means, e.g., an electric or pneumatic handler or similar means.

Advantageously, at least one part of the shelves of the units of the magazine opens on hinges along the vertical axis. This enables simple feeding of the delivery unit with large quantities of unfolded napkins and simple removal of the napkins, which results in a considerable savings of time in the folding of napkins.

Preferably, the transport unit has vacuum handling unit and a folding stage disposed above it along a vertical axis. In an alternative embodiment, the transport unit has a grip unit and a folding stage. Advantageously, this enables a secure and careful transport of unfolded napkins to the folding unit of the napkin folding device. In particular, the transport unit allows the napkins to make short trips to the folding unit, which saves both construction space and costs.

In a further embodiment, the transport unit is movably mounted on the housing of the napkin folding device along at least two axes. This way the transport unit can be moved selectively either downwards to one of the napkins disposed on the highest shelf of the delivery unit to remove the napkin from the shelf or upward from one of the napkin stacks lying on the shelf to lift the napkin from the napkin stack.

In a further embodiment, the vacuum handling unit is operatively connected to the folding stage unit by means of a separation unit. Advantageously, the napkin is in this way quickly and carefully separated from the vacuum handling unit and transported out to the folding stage unit.

Preferably, the folding unit has a robotic grip system. Advantageously, the grip system is designed in such a way that even complicated napkin forms are automatically producible. Alternatively or additionally, a corresponding tilting mechanism can be provided.

It is especially preferred to design the folding stage unit as a table, which is provided with a friction lining and/or a vacuum device and/or a separation device and/or a holding down device. Advantageously, the table serves not only to hold unfolded napkins, but also to accommodate and integrate fixing devices and separation devices. With a fixing device, a napkin can be fixed during folding, to prevent the napkin from slipping during the folding process. With a separation device, if necessary for one napkin, layers lying one on top of the other of the napkin being processed can be separated for appropriate crease patterns, in order, for example, to lift one layer and execute a folding movement with it.

Expediently, the table and/or the folding unit and/or the grip unit are designed as rotatable, preferably around a vertical axis. Advantageously, that way the table and/or the folding unit and/or the grip unit are freely adjustable.

The grip system preferably operates the folding unit together with the finger grip system of the transport unit. The finger grip system of the transport unit thereby functions as a supporting complement to the grip system of the folding unit.

A further preferred embodiment of the invention provides that the storage unit according to the invention be designed according to the paternoster principle. For this, the storage unit has two shafts in which cartridges for holding folded napkins are operated in a controlled circular operation. Through this means, it is possible to shelve large quantities of folded napkins. An emptying of the storage unit is necessary only at large intervals of time, which results in a considerable savings of time during napkin folding. Operation of the napkin folding device is therefore possible for a longer time without manual intervention. However, it is also conceivable to release folded napkins onto a conveyor belt. In this way, for example, a filled cartridge can be released onto the conveyor belt. It is just as possible to release individual folded napkins.

It is especially preferred that the napkin folding device has an inspection unit that is provided to identify deviating values. Advantageously, the inspection unit identifies primarily the layer of the respective napkin, and additionally, certain defined problems, such as tolerances and dirt. The inspection unit can consist of or comprise one or multiple pieces of optical equipment, such as cameras. Should a problem be identified such as an incorrectly placed napkin or dirt, an alarm signal may be given. If necessary, the folding process can be interrupted. Image recognition techniques may be used to identify problems.

A delivery unit for a napkin folding device is further proposed, which is configured to work together with one or multiple components of the napkin folding device according to the invention. Preferably, the delivery unit can store unfolded napkins and provide a transport unit. Preferably, the delivery unit can contain a magazine driven along a feed path in a circular direction so that it can be filled with unfolded napkins.

A transport unit for a napkin folding device is proposed, which is configured to work together with one or multiple components of the napkin folding device according to the invention. Preferably, it can include a vacuum handling unit and a folding stage disposed above it along a vertical axis. The transport unit can preferably work together with a delivery unit and carry away unfolded napkins from it and/or work together with a folding unit to deliver the unfolded napkins to it.

Further, a folding unit for a napkin folding device is proposed, which is configured to work together with one or multiple components of the napkin folding device according to the invention. Preferably, it can include a robotic grip system with which the napkins can be reproducibly automatically folded. The controls can provide a multiplicity of drive processes of the grip system, so that the desired forms are easily selectable and producible. Preferably, the folding unit can work together with a transport unit that feeds in unfolded napkins and/or removes and/or works together with a storage unit in which folded napkins can be collected and stored.

Further, a storage unit for a napkin folding device is proposed, which is configured to work together with one or multiple components of the napkin folding device according to the invention. Preferably, it can have a design according to the paternoster principle. Preferably, two shafts can be provided, in which cartridges for holding folded napkins are drivable in a controlled circular operation. The storage unit can preferably work together with a folding unit and/or a transport unit and pick up the folded napkins.

BRIEF DESCRIPTION OF THE DRAWINGS

The invention is explained below in more detail, without limiting the generality, by means of the exemplary embodiments represented in the drawings.

They show the following.

In the following figures, functionally similar working elements are designated with the same reference numbers.

DETAILED DESCRIPTION

Figure 1:
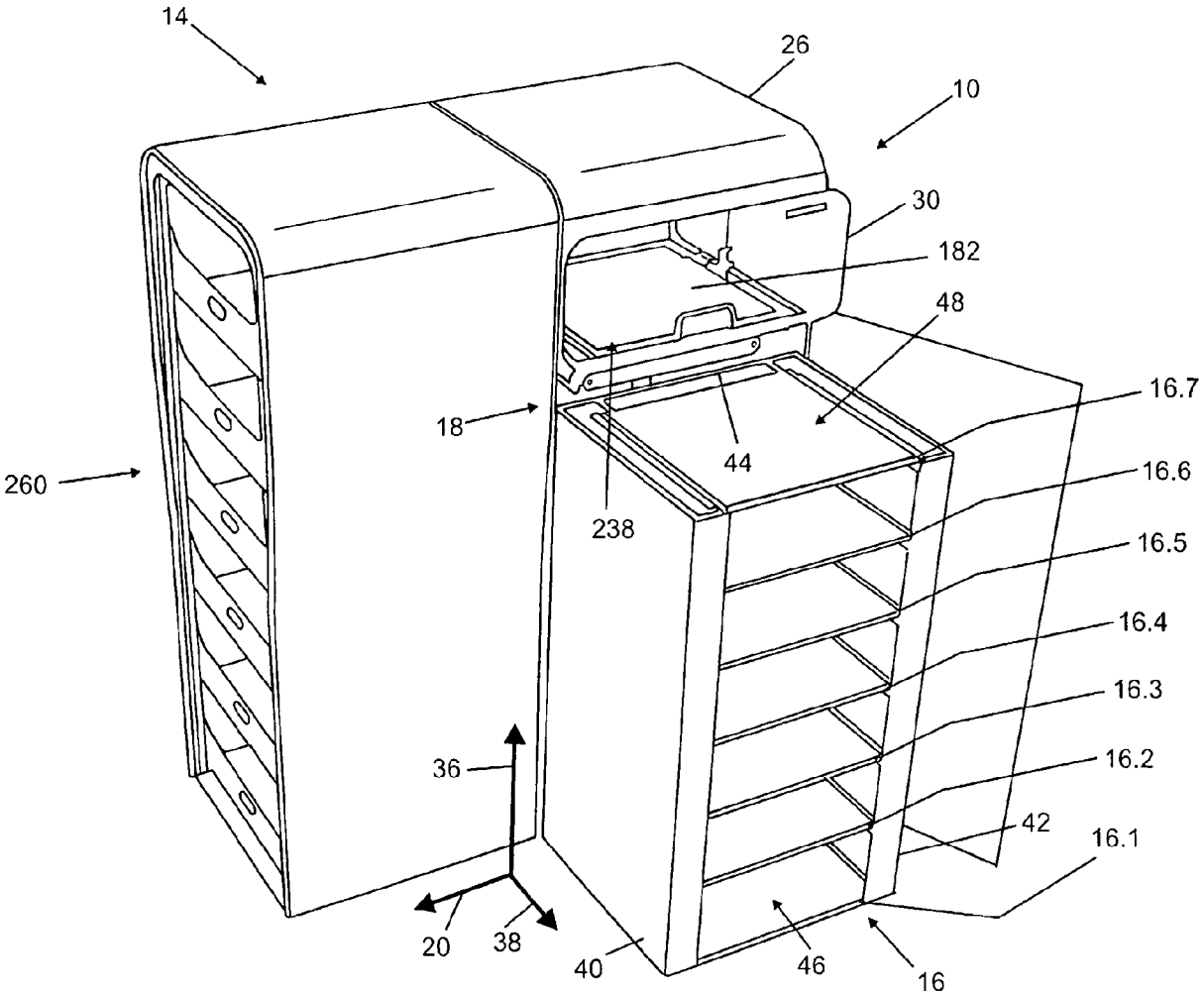
FIG. 1 A napkin folding device according to the invention in a perspective representation, with a delivery unit, a transport unit, a folding unit and a storage unit, and FIG. 2 A perspective representation of a front view of the delivery unit without housing, and FIG. 3 A perspective representation of a rear view of the delivery unit without housing, and FIG. 4 A side view of the delivery unit, and FIG. 5 A section from the upper area of the delivery unit, and FIG. 6 A section of a side view of the delivery unit with a first handling device and a second handling device, and FIG. 7 A partially depicted top view of an upper side of the delivery unit with a first actuator unit and a second actuator unit, and FIG. 8 A perspective representation of a side view of the delivery unit without housing with both actuator units from FIG. 7, and FIGS. 9*a* to 9*h* A schematic representation of a motion sequence of a shelf in the delivery unit, and FIG. 10 A schematic representation of the transport unit with a vacuum handling unit and a folding stage unit, and FIG. 11*a* to 11*c* A schematic representation of the vacuum handling unit with a conveyor belt turning on two spindles, whereby the conveyor belt is depicted in different positions, and FIG. 12 A perspective representation of the vacuum handling unit with the conveyor belt removed, whereby a matrix of spindles underneath the conveyor belt is visible, and FIG. 13 A perspective representation of the vacuum handling unit which is actuated by a pressure generating unit, and FIG. 14 A perspective representation of the folding stage unit with a folding stage, which has a bore matrix for the passage of air, and slots for holding elements to exit, and FIG. 15 A schematic representation of the motion sequence of one of the holding elements exiting the slot of the folding stage, and FIG. 16 A perspective representation of a side view of the vacuum handling unit with a space disposed under the folding stage, in which the holding elements are located when retracted, and FIG. 17 A perspective representation of a partial top view of the folding stage unit, which is operatively connected by means of a separation unit with the vacuum handling unit, and FIG. 18 The separation unit with an outer guide unit cut out enabling a view of an inner guide unit, and FIG. 19 A side view of the vacuum handling unit, whereby the load strand of a belt is pushed against the inner guide unit of the separation unit and therefore against a napkin, and FIG. 20 A first alternative embodiment of a transport unit, and FIGS. 21*a* to 21*i* A schematic representation of the motion sequence of the transport unit from FIG. 20, and FIGS. 22*a* to 22*e* A second alternative embodiment of a transport unit with a schematic representation of the motion sequence of the transport unit, and FIGS. 23*a* to 23*f* A third alternative embodiment of a transport unit with a schematic representation of the motion sequence of the transport unit, and FIG. 24 A perspective representation of a front view of the folding unit without housing with a grip system containing working tools, whereby the working tools are configured as a grip, and FIG. 25 Working tools configured as geometrical bodies of the grip system, and FIG. 26 Working tools of the grip system configured as holding and/or supporting elements, and FIG. 27 Working tools of the grip system configured as hinged elements, and FIG. 28 Working tools of the grip system configured as sliding elements, and FIGS. 29*a* to 29*l* Napkin shapes which are producible by the grip system, and FIG. 30 A perspective representation of a side view of the storage unit without housing.

FIG. 1 shows a napkin folding device according to the invention with a folding unit 10, which is provided to fold individual napkins 12, and a storage unit 14 which is provided to hold the folded napkins 12 from the folding unit 10. The napkin folding device also has a delivery unit 16, which is provided to hold out unfolded napkins 12, and a transport unit 18, which is provided to feed the unfolded napkins 12 from the delivery unit 16 to the folding unit 10.

The above named four units 10, 14, 16, and 18 of the napkin folding device are operatively connected to each other or are functionally linked to one another, i.e., the delivery unit 16 is coupled with the transport unit 18, which is in turn connected to the folding unit 10, which is in turn coupled with the storage unit 14. This means that each individual napkin 12 passes through the four units 10, 14, 16, and 18 of the napkin folding device.

In the foregoing exemplary embodiment, the units 10, 14, 16, and 18 are disposed in such a way that they create two towers 22 and 24, which lie side by side along a longitudinal axis 20. A first tower 22 contains the storage unit 14. A second tower 24 contains the delivery unit 16, the transport unit 18, and the folding unit 10, whereby the elements 16, 18, and 10 are disposed on top of each other in this sequence. There are, however, other conceivable arrangements of the units 10, 14, 16, and 18, which might seem sensible to an expert.

The units 10, 14, 16, and 18, or the towers disposed side by side 22, 24, are preferably accommodated in a common housing body 26 which has at least one door 28, 30 to access the units 10, 14, 16, and 18. In the foregoing exemplary embodiment, the housing body 26 is configured as a rectangle. It is preferred that edges 34 which are disposed on an upper side 32 of the housing body 26 and which face a user of the napkin folding device are constructed so that they are rounded. Preferably, the housing body 26 is made of metallic material, but other materials that might seem sensible to an expert are conceivable for the housing body 26.

As per FIG. 1, the delivery unit 16 is preferably configured as a cuboid standing on a base part with a vertical axis 36, a transverse axis 38 perpendicular to the vertical axis 36, and a longitudinal axis 20 running perpendicular to the transverse axis, which has two side walls 40 and 42, a closed back wall 44 and an open front 46 as well as an open top 48. Preferably, the cuboid is stored on rails not depicted here and preferably can pull out or move out fully from the housing 26 of the napkin folding device along the transverse axis 38, which serves mainly for maintenance purposes, and to a lesser extent for the refilling of the delivery unit 16 with napkins.

Figure 2:
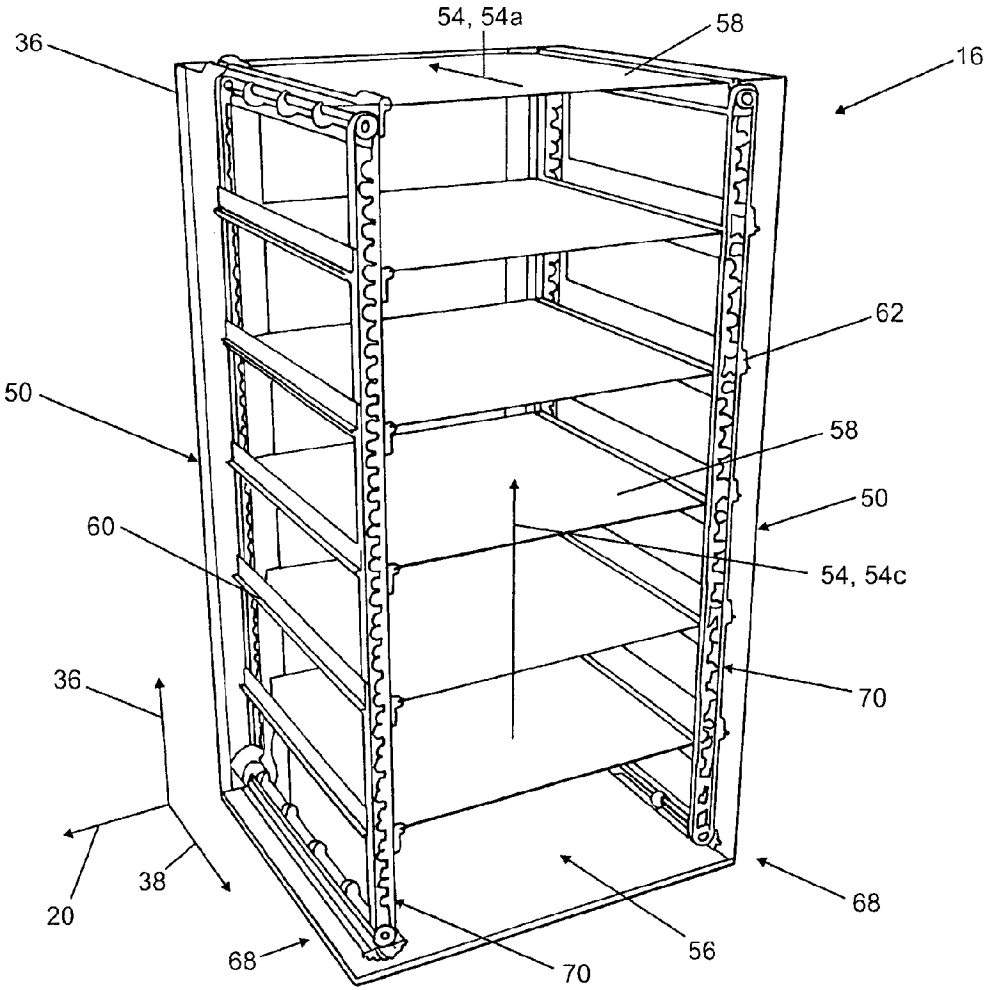

A frame structure 50 is disposed in the cuboid according to FIG. 2 from the corner profiles 52 on the edges of the cuboid running along the vertical axis 36. The delivery unit 16 has a magazine 56 driven along a feed path in the frame structure 50 in a circular direction 54, which [magazine] is to be filled with unfolded napkins 12.

In order to specify a napkin folding device that makes possible a significant improvement in the folding of napkins 12, the delivery unit 16 has a magazine 56 with at least two delivery levels 16.1 to 16.7 according to FIG. 1.

The magazine 56 has multiple shelves 58 which are disposed one upon another, spaced apart from each other, essentially parallel along the vertical axis 36, whereby each shelf 58 is stored in pairs with the guide rails 60, 62 opposite one another in the frame structure 50; i.e., there is a shelf 58 between each of the two guide rails 60, 62 disposed opposite to the direction of the longitudinal axis 20. Each shelf 58 lies in one of each delivery level 16.1 to 16.7. The guide rails 60, 62 running along the transverse axis 38 are disposed adjacent to the sidewalls 40, 42 of the cuboid. The shelves 58 are constructed to be flexible or bendable. In the foregoing exemplary embodiment, the shelves 58 are lamellar, but the embodiment is conceivable in [another] flexible or bendable material, or other embodiments that might seem sensible to an expert. Each shelf 58 serves to hold a stack of unfolded napkins 12.

To drive the magazine 56 containing the guide rails 60, 62 and the shelves 58 in the circular direction 54, in the frame structure 50 a handling unit 68 is provided with a first handling device 70 and a second handling device 72, whereby the circular direction 54 consists of or comprises components 54*a*, 54*b* running along the transverse axis 38 and components 54*c*, 54*d* running along the vertical axis 36. The first handling device 70 is provided for driving the guide units 60, 62 in the frame structure 50 and the second handling device 72 for driving the shelves 58 along the rear wall 44 of the frame structure 50.

Figure 3:
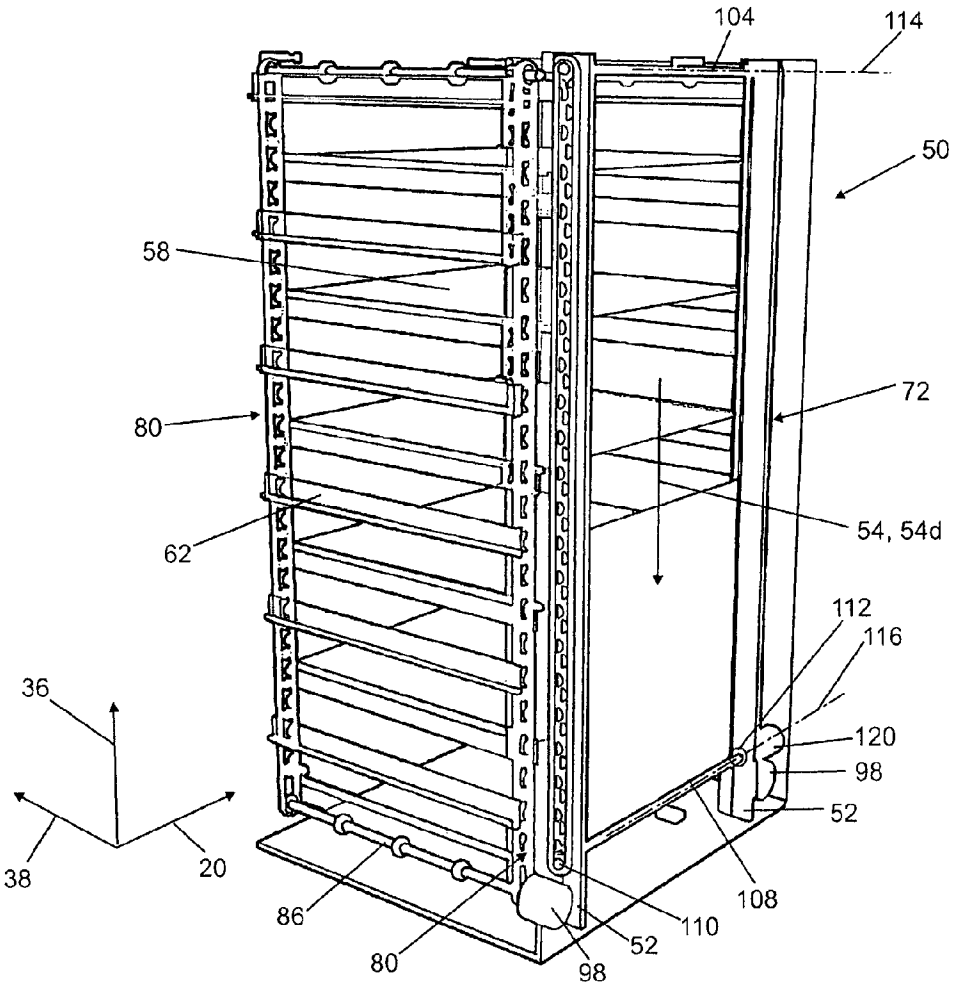
Figure 4:
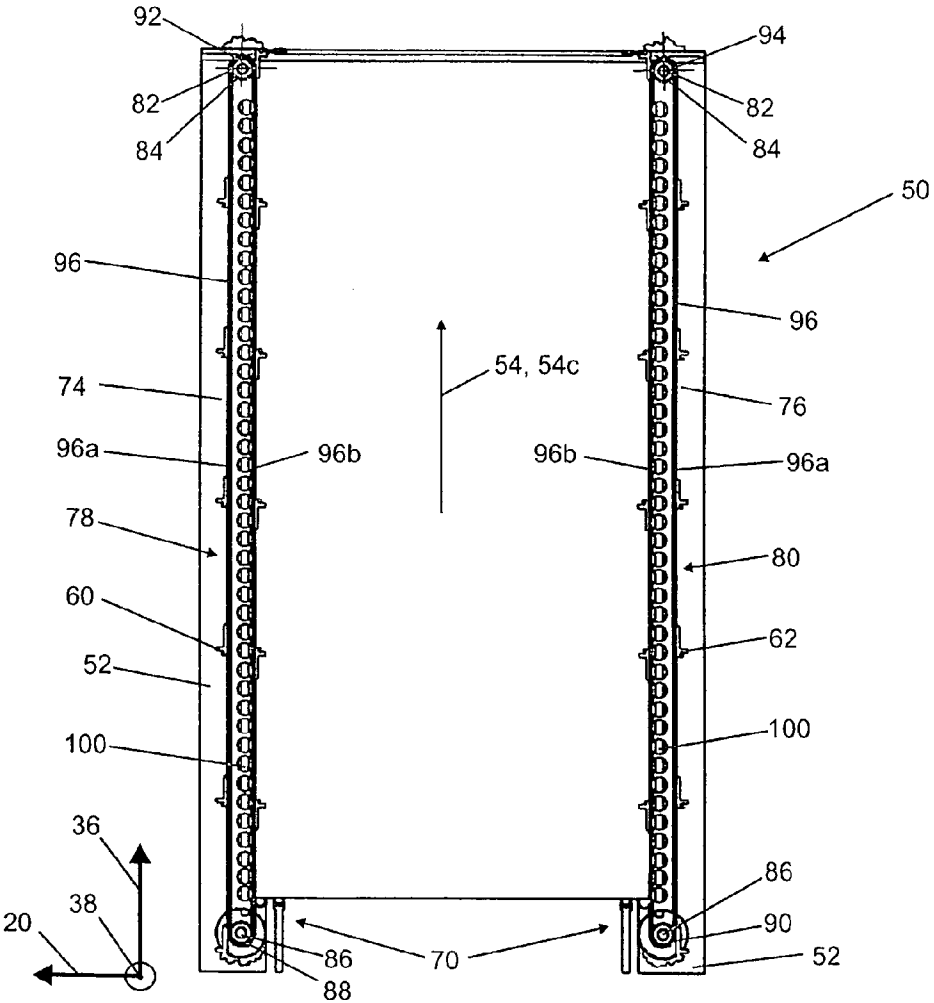

In FIGS. 3 and 4 the first handling device 70 is shown in detail, whereby the handling device 70 consists of or comprises two drive units 74, 76 disposed opposite the direction of the longitudinal axis 20. The drive units 74, 76 consist of or comprises in turn units 78 and 80 disposed in pairs on the corner profile 52 of the frame structure 50 and disposed opposite the direction of the transverse axis 38, which are preferably configured as belt drives and particularly as cleat belt drives. Each drive unit 74, 76 has a geodetic spindle 82 with drive wheels 84 disposed above, and a geodetic spindle 86 with drive wheels 88, 90 disposed below, whereby the axes 92, 94 of the spindles 82, 84 run along both side walls 40, 42 of the cuboid or along the transverse axis 38 of the napkin folding device. A cleat belt 96 turns around the drive wheels designed as gears 84, 88 and 90. The guide rails 60, 62 provided for storing the shelves 58 are attached to belt drive units 74, 76, which turn with the belt 96. The magazine 56 with the shelves 58 and the guide rails 60, 62 is drivable by means of the first handling device 70 in the circular direction 54 or in a circular operation along a feed path. Each of the two drive units 74, 76 is provided with a drive 98 preferably disposed in the area of the rear wall 44 of the frame structure 50, which preferably drives the underlying spindle 86 by means of drive wheels 88 or 90. The turning belt 96 has two free belt sections 96*a*, 96*b* designated as strands, whereby the pulling belt section is designated as the load strand 96*a* and the pulled strand as the empty strand 96*b*. In the foregoing exemplary embodiment, the empty strand 96*b* is directed inwards and the load strand 96*a* is directed outwards. The drive 98 is preferably designed as a step motor. In the foregoing exemplary embodiment, the step motors 98 of the belt drive units 74, 76 are synchronized with each other. Inside the area created by the turning belts 96, there is a pressing unit 100 disposed, which presses against the empty strand 96*b* of the belt 96.

Figure 5:
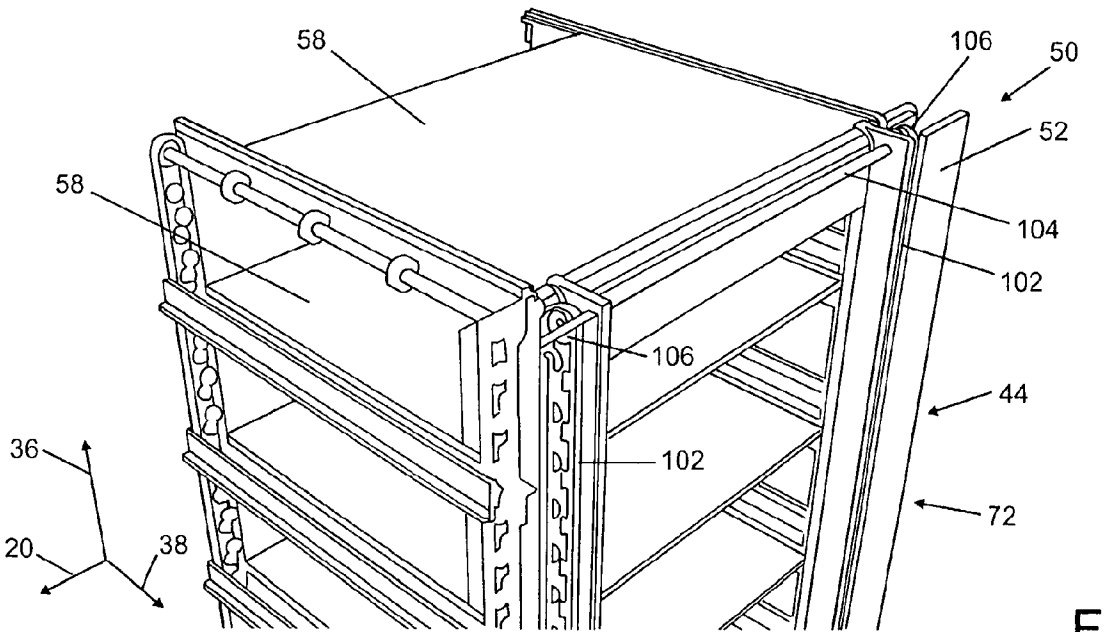
Figure 6:
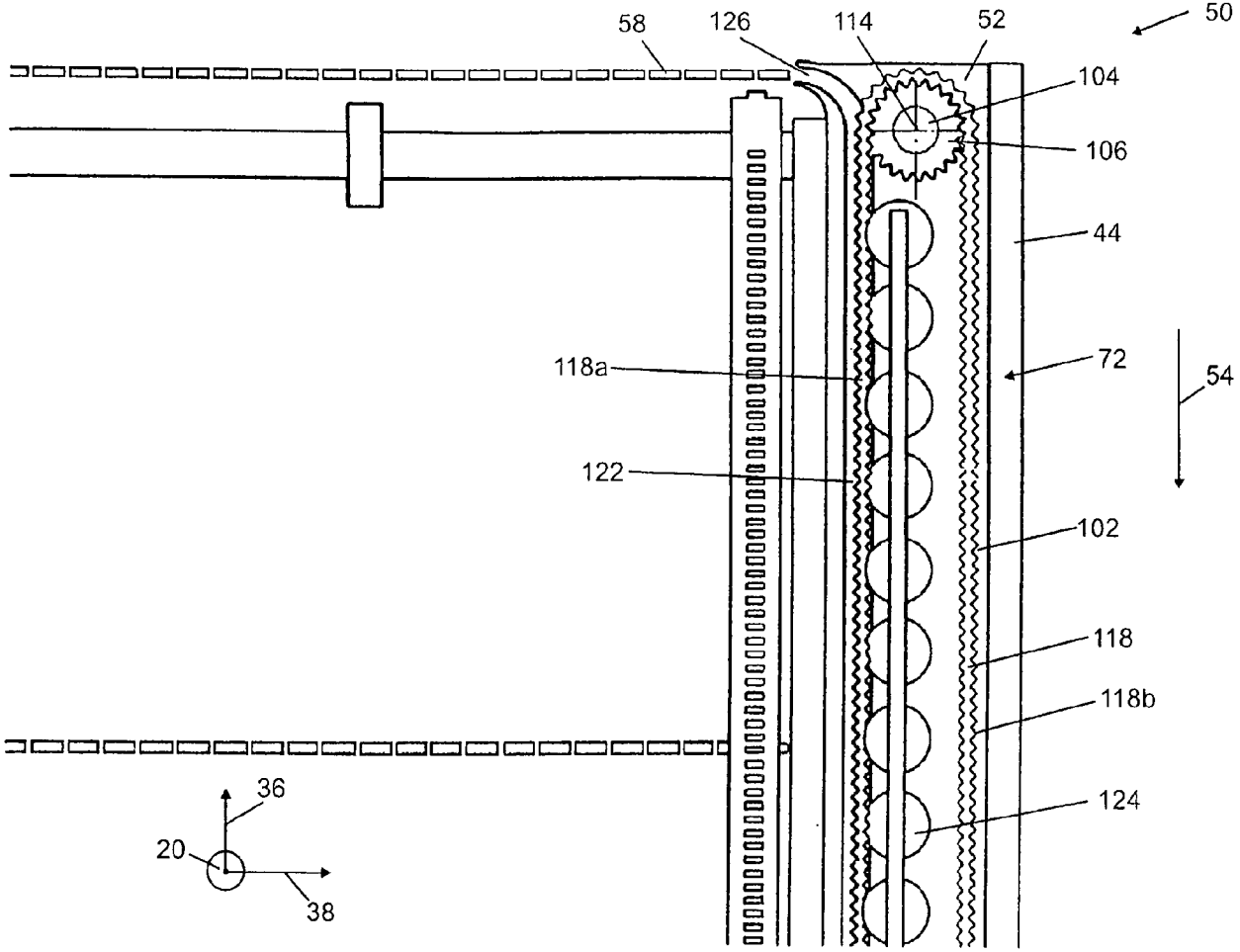

In FIGS. 5 and 6, the second handling device 72 for driving the shelves 58 along the rear wall 44 of the frame structure 50 is shown in detail. The second handling device 72 consists of or comprises two drive units 102 disposed in pairs on the corner profile 52 which is disposed on the rear side of the frame structure 50, which [drive units] are likewise preferably configured as belt drive devices and particularly as cleat belt drive devices. That means the drive units 102 are disposed in the area of the rear wall 44 of the cuboid in the frame structure 50, spaced apart from each other along the longitudinal axis 20. The drive units 102 have a common geodetic spindle 104 with two drive wheels 106 disposed above, and a common geodetic spindle 108 with two drive wheels 110 and 112 disposed below, whereby the axes 114 and 116 of the spindles 104, 108 run along the hack wall of the frame structure 50 or along the longitudinal axis 20. A cleat belt 118 turns around the two drive wheels designed as gears 106 or 110 and 112 of a drive device 102. The drive devices 102 are provided with a drive 120 preferably in the area of a side wall 40 or 42 of the frame structure 50, which preferably drives the underlying spindle 108 by means of one of the drive wheels 110 or 112. The drive 120 is preferably configured as a step motor. In the foregoing exemplary embodiment, the empty strand 118*a* of the belt 118 is directed inwards and the load strand 118*b* of the belt 118 is directed outwards.

The corner profile 52 and the drive devices 102 are formed in such a way that a profile guideway 122 for transporting shelves 58 arises between the guide rails 60, 62 and the belt 118 which runs along the vertical axis 36, which is drivable in a circular direction 54 downward along the vertical axis 36. Inside the area created by the circulating belt 118 a pressing unit 124 is disposed which presses against the empty strand 118*a* of the belt 118, whereby the belt 118 is pressable against a shelf 58 located in the profile guideway 122. The shelf 58 is collected and pulled along by the belt 118. On the upper end of the corner profile 52, the profile guideway 122 has an entry slot 126 for inserting a shelf 58 in the profile guideway 122.

Figure 7:
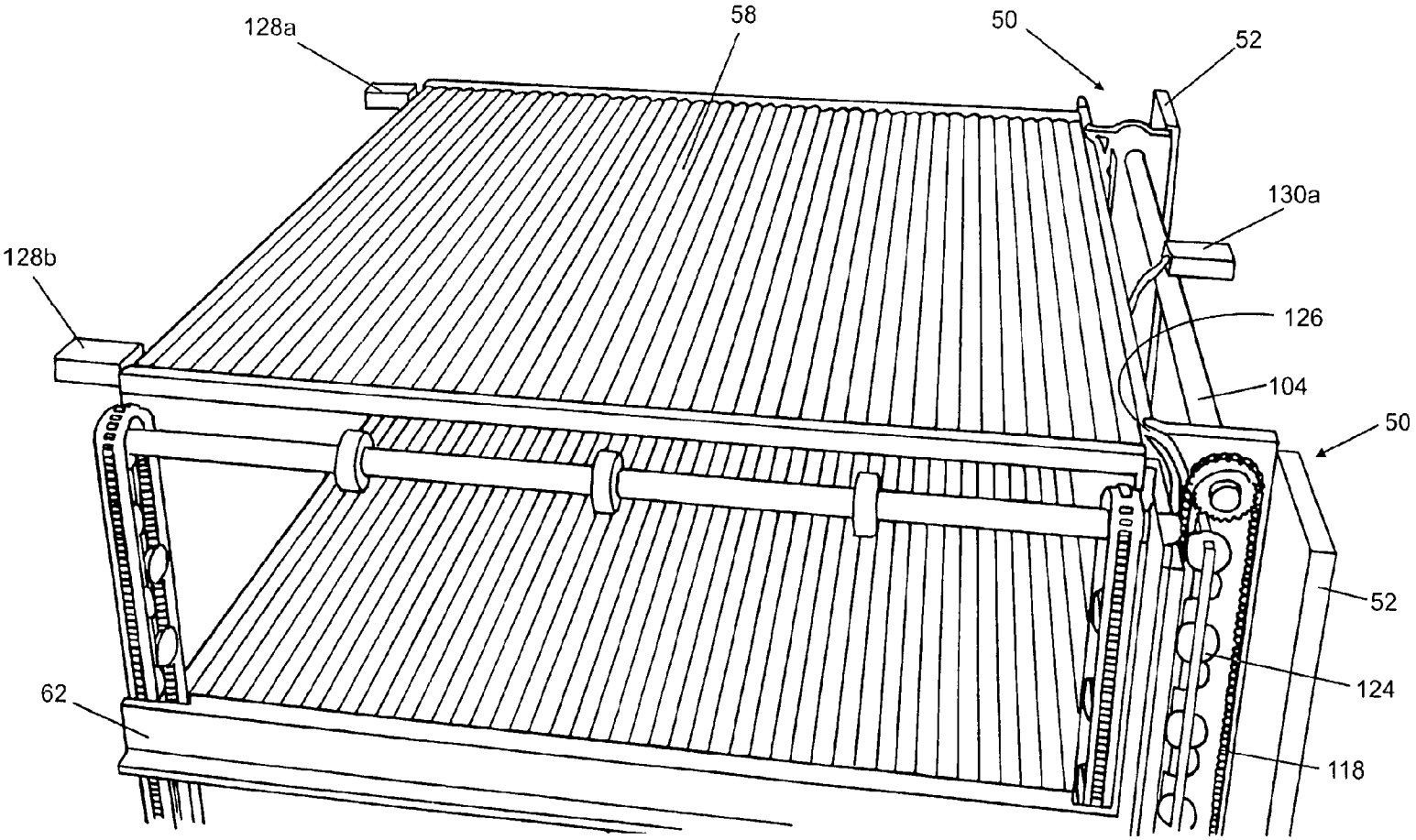
Figure 8:
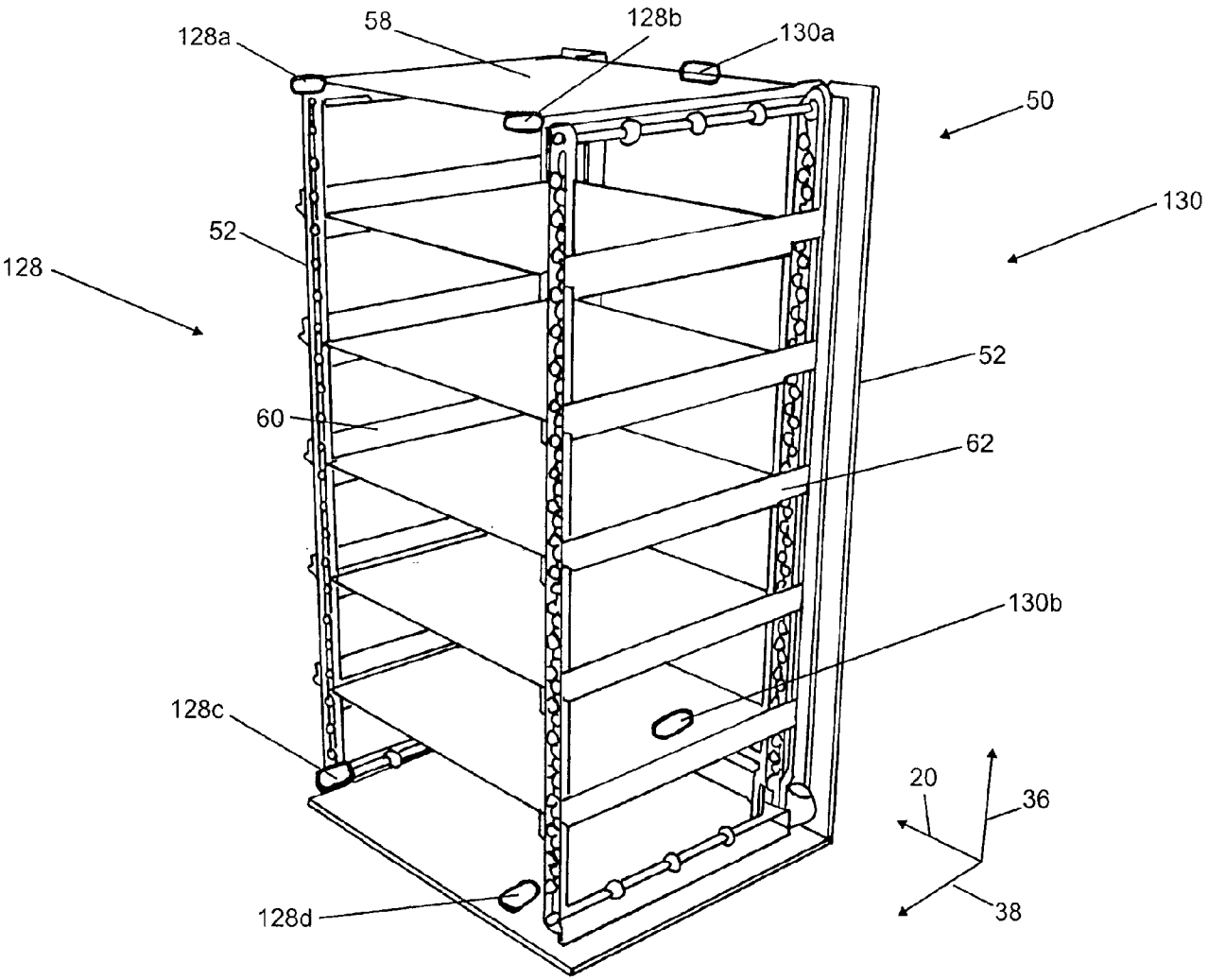

On the front side of the frame structure 50 according to FIGS. 7 and 8, a first actuator unit 128 is disposed, which preferably consists of or comprises four actuators 128*a*, 128*b*, 128*c*, 128*d*, two of which actuators 128*a*, 128*b* are disposed in the upper area of the corner profile 52 and two of which actuators 128*c*, 128*d* are disposed in the lower area of the corner profile 52. By means of the upper actuators 128*a*, 128*b* a shelf 58 located on the upper end of the corner profile 52 is drivable along the transverse axis 38, which means in the direction of the entry slot 126 and the profile guideway 122, and by means of the lower actuators 128*c*, 128*d*, a shelf 58 located in the lower area of the corner profile 52 in the profile guideway 122 can be drawn out of the profile guideway 122 into the guide rails 60, 62. On the back side of the frame structure 50, a second actuator unit 130 is preferably disposed, consisting of or comprising two actuators 130*a*, 130*b*, whereby one actuator 130*a* is disposed in an upper area of the frame structure 50 and one actuator 130*b* is disposed in a lower area of the frame structure 50. By means of the upper actuator 130*a*, a shelf 58 located on the upper end of the corner profile 52 is drawable along the transverse axis 38, which means in the direction of the entry slot 126 and the profile guideway 122, and by means of the lower actuator 130*b*, a shelf 58 located in the lower area of the corner profile 52 in the profile guideway 122 is drivable out of the profile guideway 122 into the guide rails 60, 62. Because the drive devices 102 of the second handling device 72 cannot thrust the shelves 58 fully into the guide rails 60, 62, the shelves 58 are countersunk by the rear actuator 130*b*, which is disposed underneath.

Figure 9:
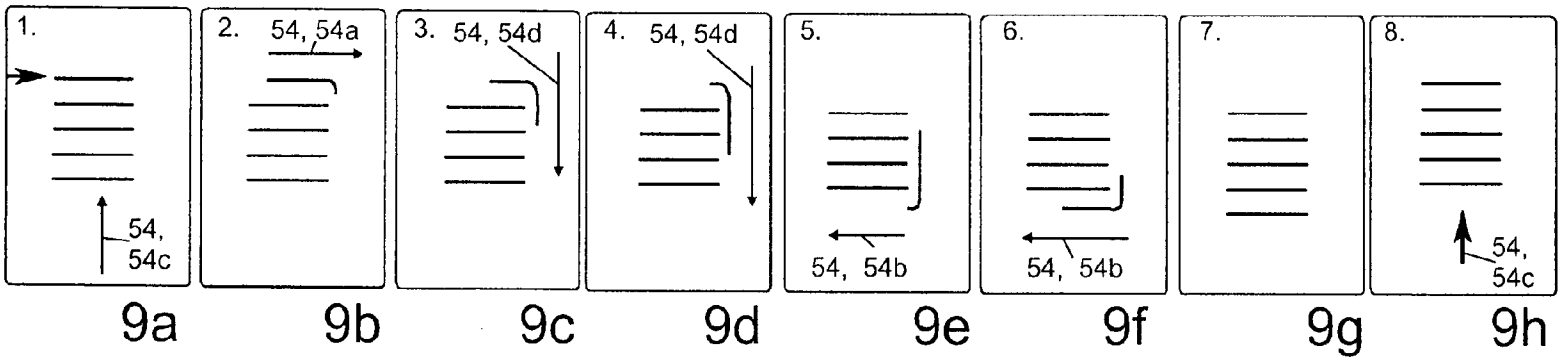

FIGS. 9*a* to 9*h* show a schematic representation of the motion sequence of the magazine 56 containing the guide rails 60, 62 and the shelves 58, in which the first handling device 70 is provided to drive the guide rails 60, 62 in the frame structure 50, and the second handling device 72 to drive the shelves 58 along the rear side of the frame structure 50. FIG. 9*a* shows the initial state of the motion sequence of the magazine 56. In FIGS. 9*b* through 9*d*, the uppermost shelf disposed in delivery level 16.7 is driven by the second handling device 72 in the direction of the profile guideway 122 or along the transverse axis 38, inserted into the entry slot 126 of the profile guideway 122, and driven upward along the vertical axis 36. In FIGS. 9*e* and 9*f*, the shelf 58 is diverted from movement along the vertical axis 36 along the transverse axis 38. In FIG. 9*g*, the shelf 58 is located in the guide rails 60, 62 in the lowest position, disposed in delivery level 16.1 in magazine 56, and from there according to FIG. 9*h* is driven upward along the vertical axis 36 by means of the first handling device 70 with the guide rails 60, 62. Basically, the second handling device 72 transports the upper empty shelf 58 back to the guide rails 60, 62 of the first handling device 70.

Advantageously, the delivery unit 16 is located in at least one delivery level 16.1 to 16.6 in a loading position and in at least one delivery level 16.7 in an unloading position. In the foregoing exemplary embodiment the upper shelf 58 is located in delivery level 16.7 and therefore in the unloading position. The shelves 58 disposed beneath are located in the delivery levels 16.1 to 16.6 and therefore in the loading position. In the loading position, the magazine 56 or the shelf 58 of the delivery unit 16 can be refilled with napkins 12.

Figure 10:
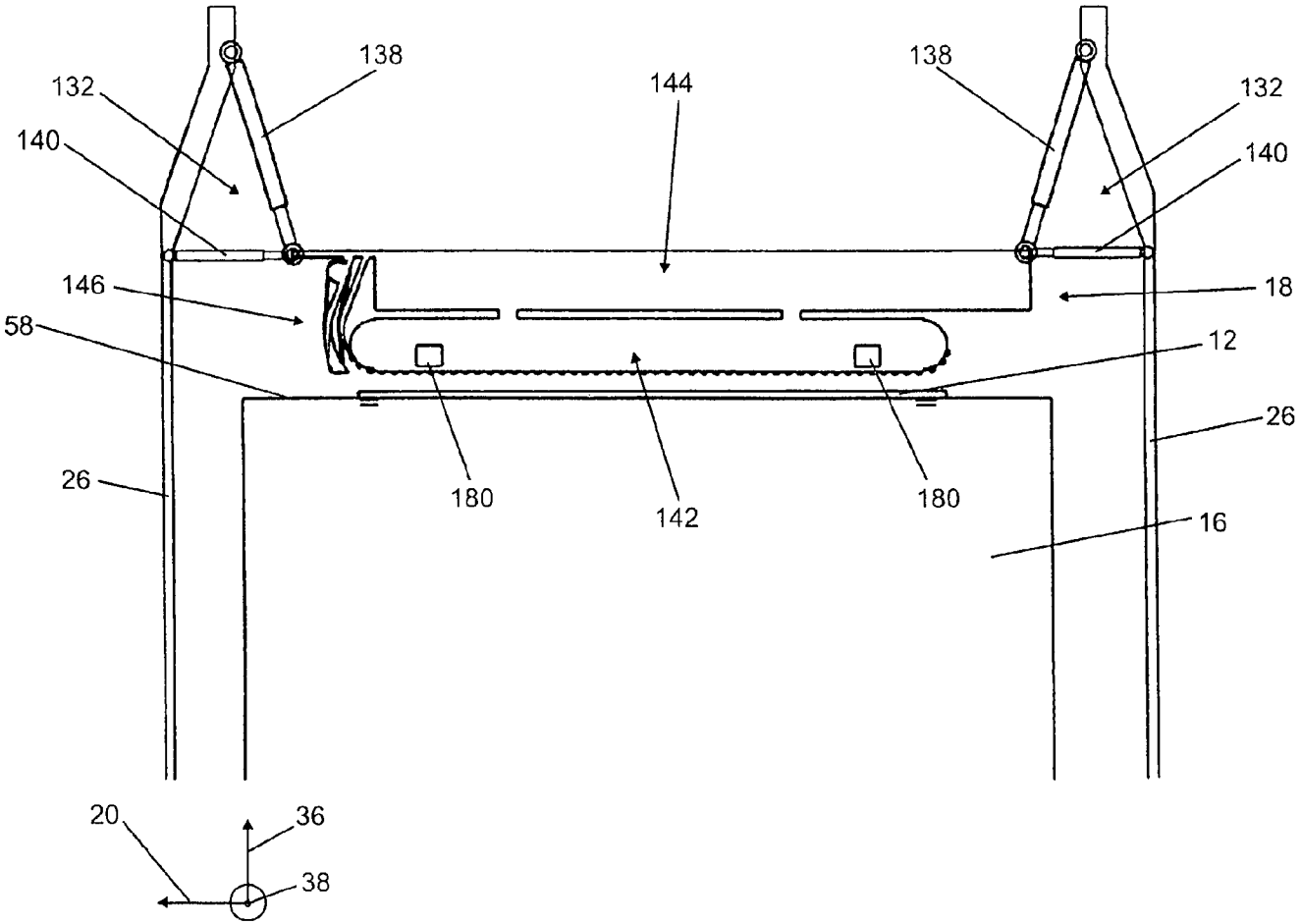

In the foregoing exemplary embodiment, the transport unit 18 is located, according to FIG. 1, directly over the delivery unit 16. As depicted in FIG. 10, the transport unit 18 is fastened moveably by means of a fixing unit 132 to the housing 26 of the napkin folding device preferably along two axes 20, 36. The fixing unit 132 can preferably be a fixing actuator 138, 140 or a rail system, by means of which the transport unit 18 is suspendable on the housing 26 of the napkin folding device. In the foregoing exemplary embodiment, the transport unit 18 is suspended at four points with two fixing actuators 138, 140, each movable by the delivery unit 16 along the longitudinal axis 20 and along the vertical axis 36. Because the transport unit 18 is fastened to the housing 26 of the napkin folding device by means of a fixing unit 132 and is moveable along two axes 20, 36, it can, in a defined way, be moved downward toward the napkin 12 lying on the uppermost shelf 58 of the delivery unit 16 to remove the napkin 12 from the shelf 58 or be moved upwards from one of the napkin stacks lying on the shelf 58 in order to lift the napkin 12 from the rest of the napkin stack.

Figure 11A:
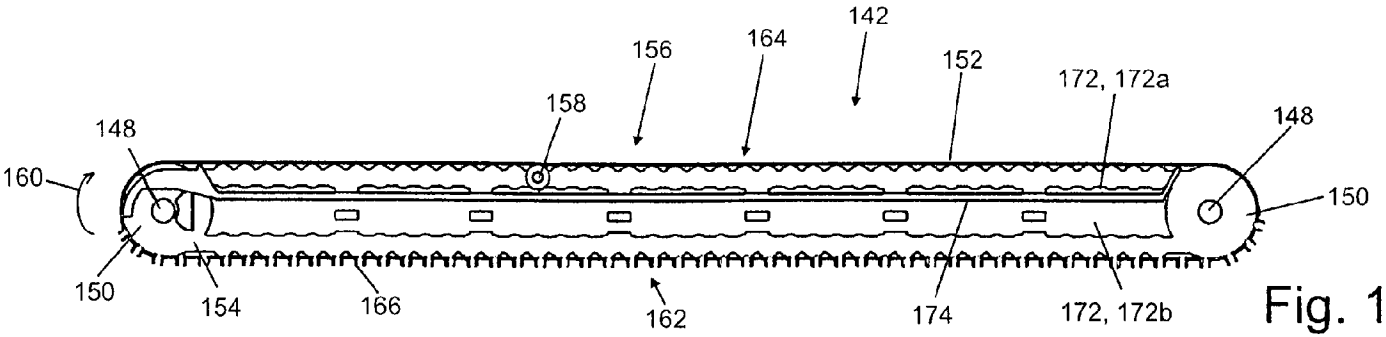
Figure 11B:
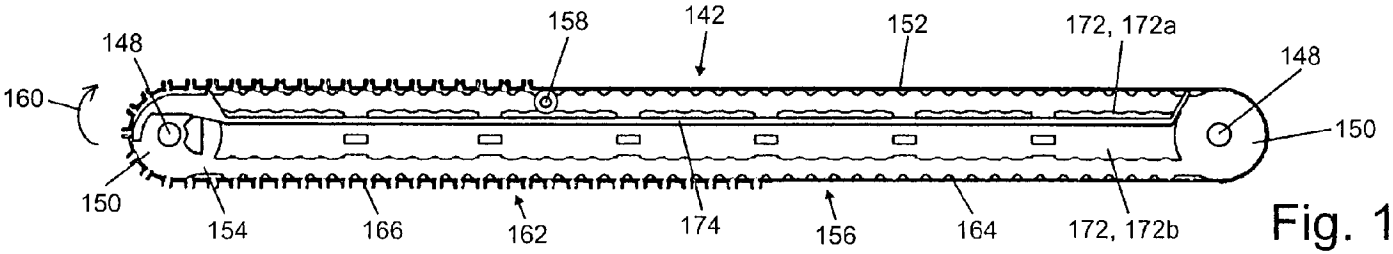
Figure 11C:
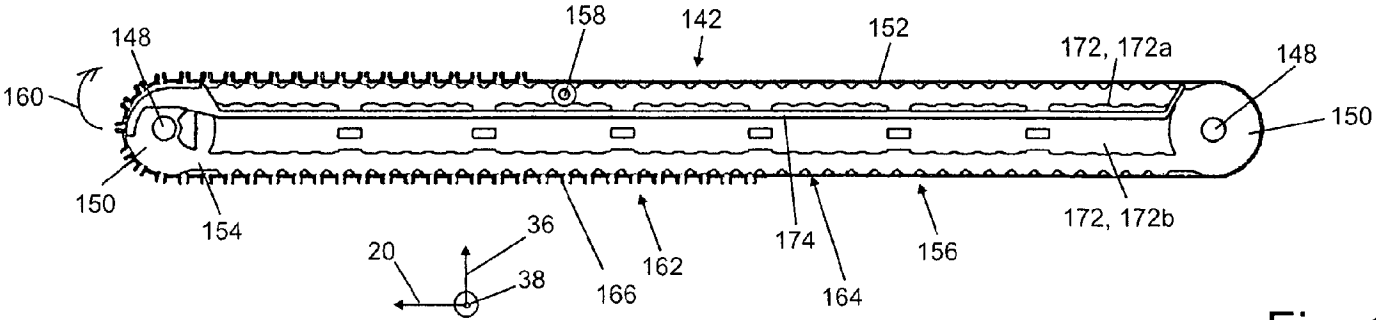
Figure 12:
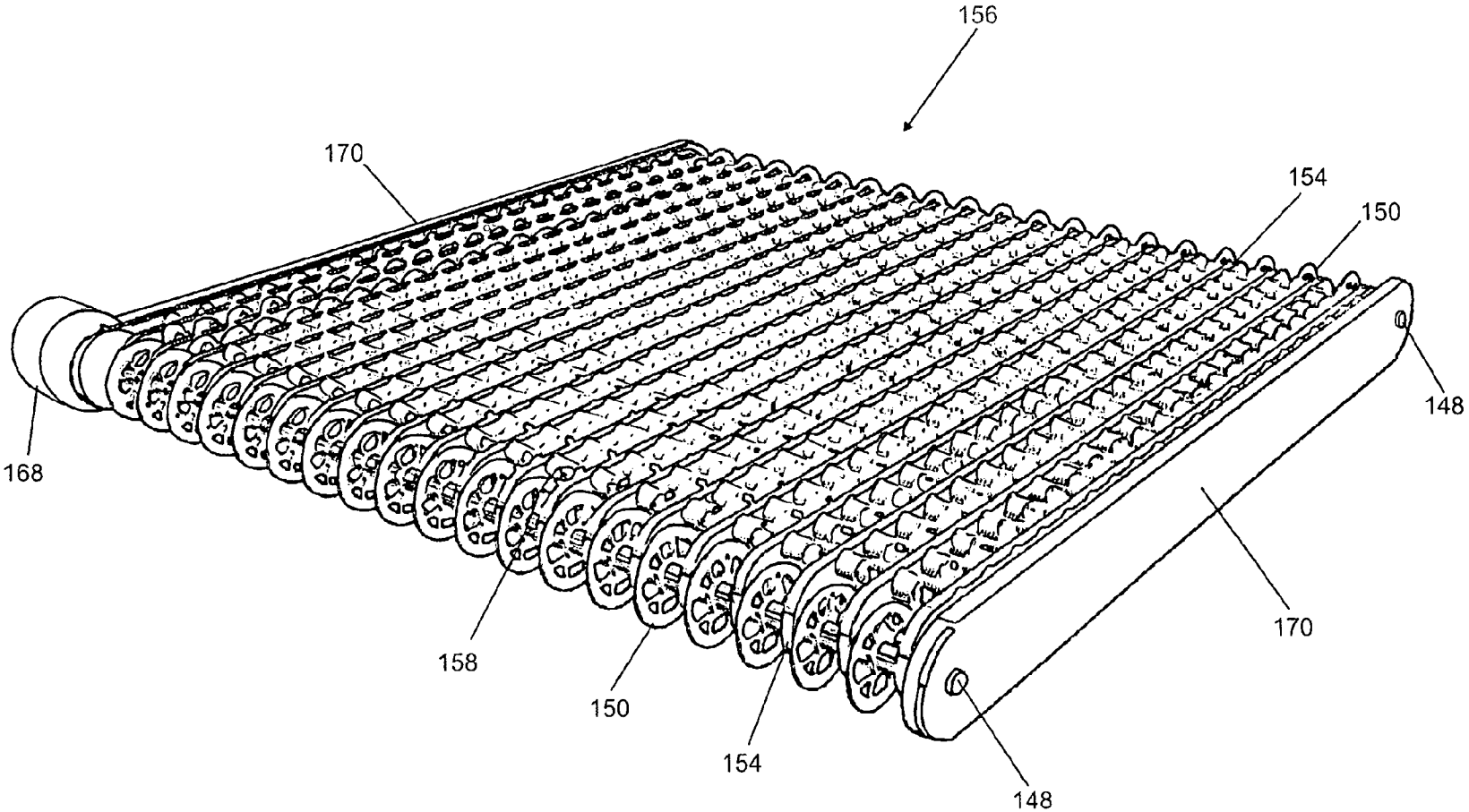

The transport unit 18 has a vacuum handling unit 142 and a folding stage unit 144 disposed above along the vertical axis 36. The vacuum handling unit 142 and the folding stage unit 144 are operatively connected on one side by means of a separation unit 146. As per FIGS. 11*a*, 11*b*, 11*c*, and 12, the vacuum handling unit 142 has two spindles 148 spaced apart from one another along the longitudinal axis 20 and running along the transverse axis 38, each of which have multiple drive rolls 150. The drive rolls 150 are preferably disposed at regular distances on the spindles 148. A conveyor belt 152 turns as per FIG. 11*a* to 11*c* by means of the drive rolls 150, and is supported by means of a roll array 156 of freely mounted rolls 158 disposed at small distances stored in a caster 154 extending parallel to the conveyor belt 152. This roll array 156, formed as a network of freely mounted rolls 158 covering a large area, prevents the conveyor belt 152 from collapsing back upon itself due to the vacuum and creating too much friction. The circular conveyor belt 152 has in one circular direction 160 an area permeable to air 162 and an area not permeable to air 164, whereby preferably one first half of the conveyor belt 152 is configured as permeable to air and one second half of the conveyor belt 152 is configured as not permeable to air. In the area permeable to air 162 the conveyor belt 152 preferably has knobs 166 configured as suction knobs, through which air can pass, which are configured preferably at small regular distances on the conveyor belt 152. Preferably, the rolls 158 of the roll array 156 are configured either as grooved or provided with grooves running in the circular direction 160, in order to allow the flow of air to the knobs 166 through which air can pass. The vacuum handling unit 142 is provided with a drive 168 preferably disposed outside the conveyor belt 152, which preferably drives the spindle 148 disposed in front via one of the drive rolls 150. The drive 168 is preferably configured as a step motor.

Figure 13:
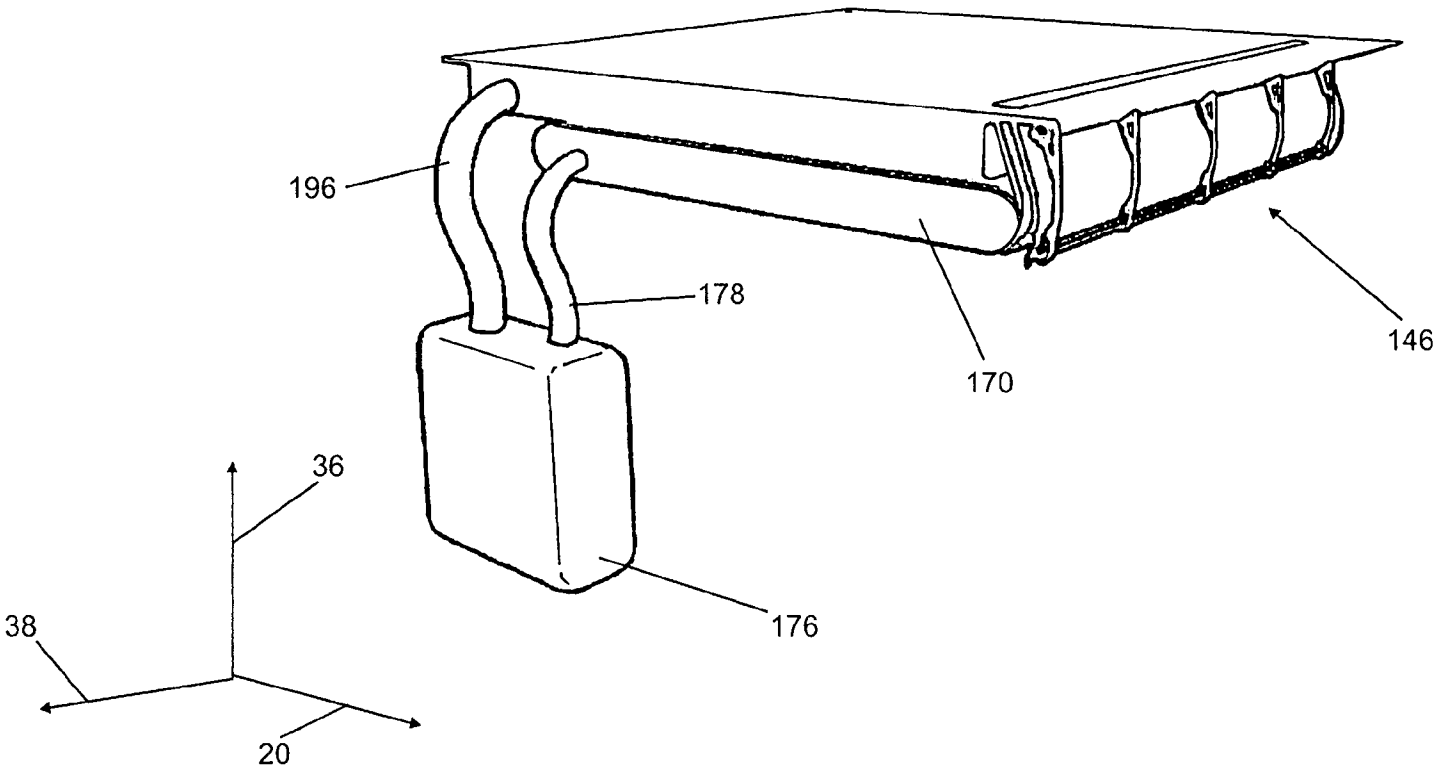

Inside the area 172 formed by the circular conveyor belt 152 and two lateral cover profiles 170 running along the longitudinal axis 20, there is a sealing unit 174 provided, which divides the area into a pressurized chamber disposed above 172*a* and a pressurized chamber disposed below 172*b*, whereby the pressurized chamber disposed above 172*a* has ambient pressure and the pressurized chamber disposed below 172*b* has negative pressure. As per FIG. 13, the pressurized chamber disposed below 172*b* is operatively connected with a pressure-generating unit 176 to create a vacuum preferably on the rear side, for example, by means of a flexible hose 178, which can create both a vacuum and pressure.

The transport unit 18 has as per FIG. 10 a sensor unit 180, which serves to detect a napkin 12 on the uppermost shelf 58 of the delivery unit 16. The sensor unit 180 is preferably a light barrier unit. For this, the surfaces of the shelves 58 are configured wholly or partially as reflecting. The sensor unit 180 is disposed above the shelf 58 of the delivery unit 16, preferably on the cover profile 170 of the conveyor belt 152 and preferably sends a steady light signal to the shelves 58. If there is at least one napkin 12 on the shelf 58, the light signal will not reflect, but be interrupted. If there is no napkin 12 on the shelf 58, the light signal sent from the sensor unit 180 will reflect, and be received by the sensor unit 180. Hereby the motion sequence is initiated to change the shelf 58 in the delivery unit 16.

Figure 14:
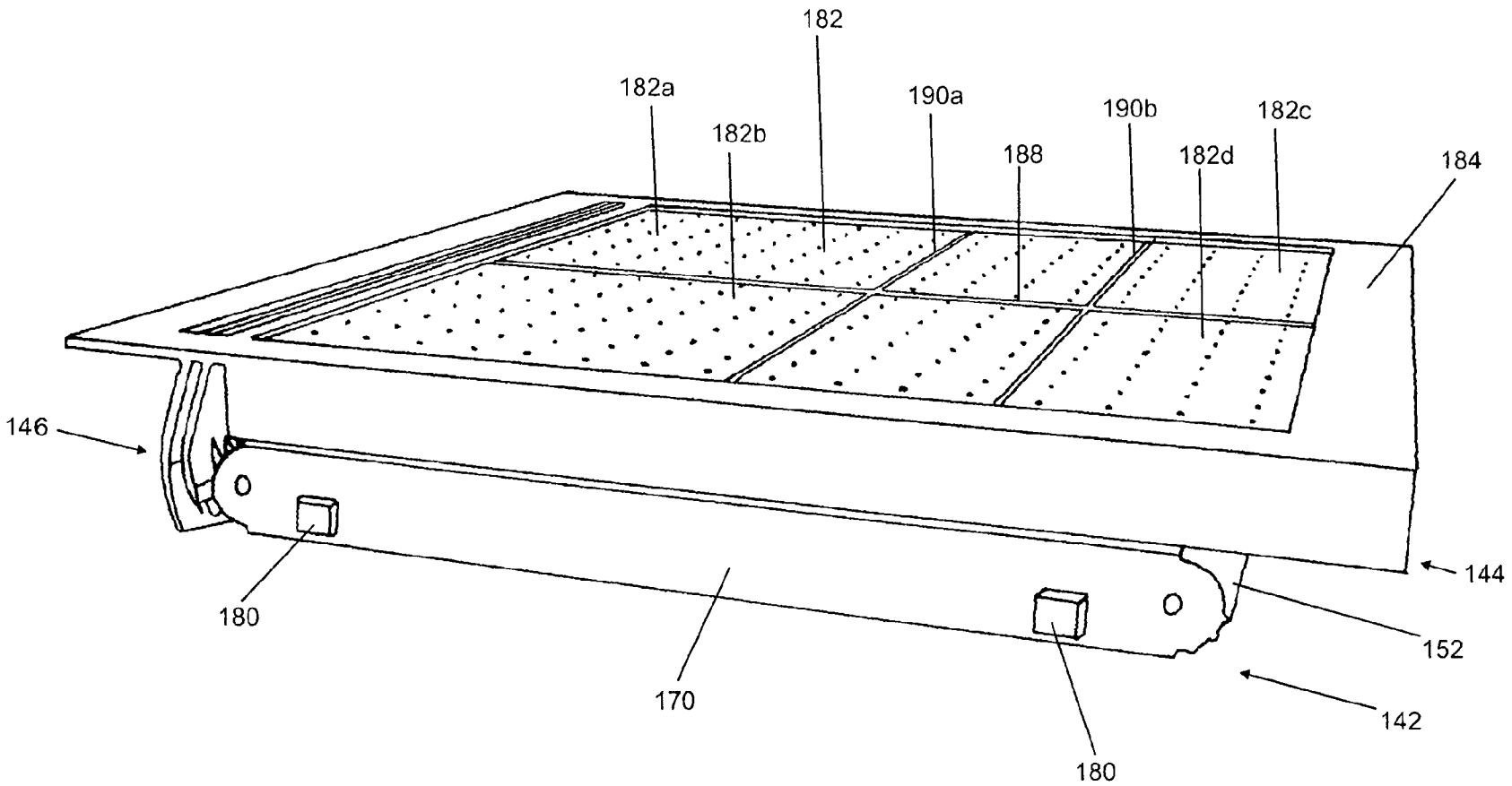
Figure 15:
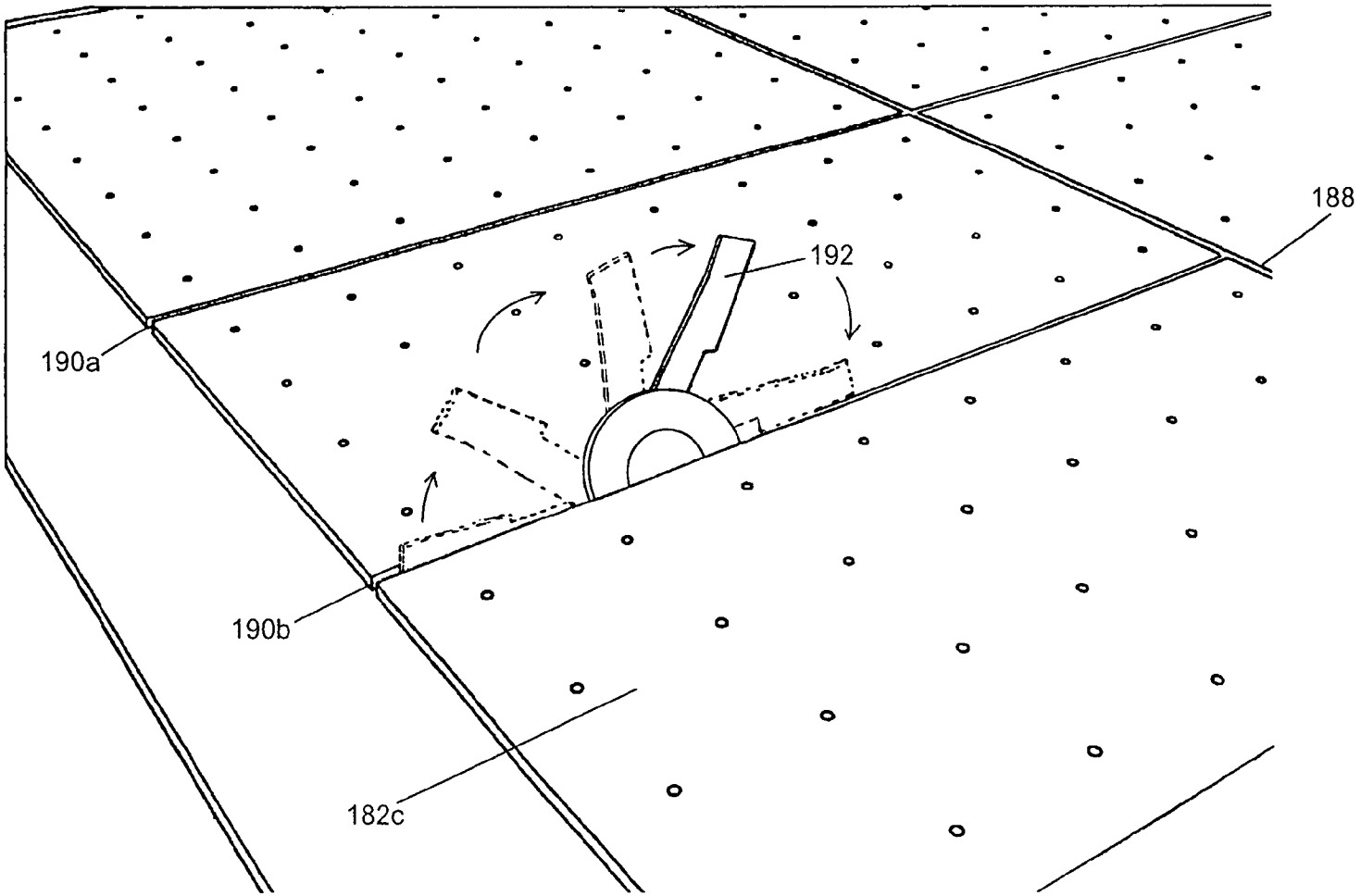
Figure 16:
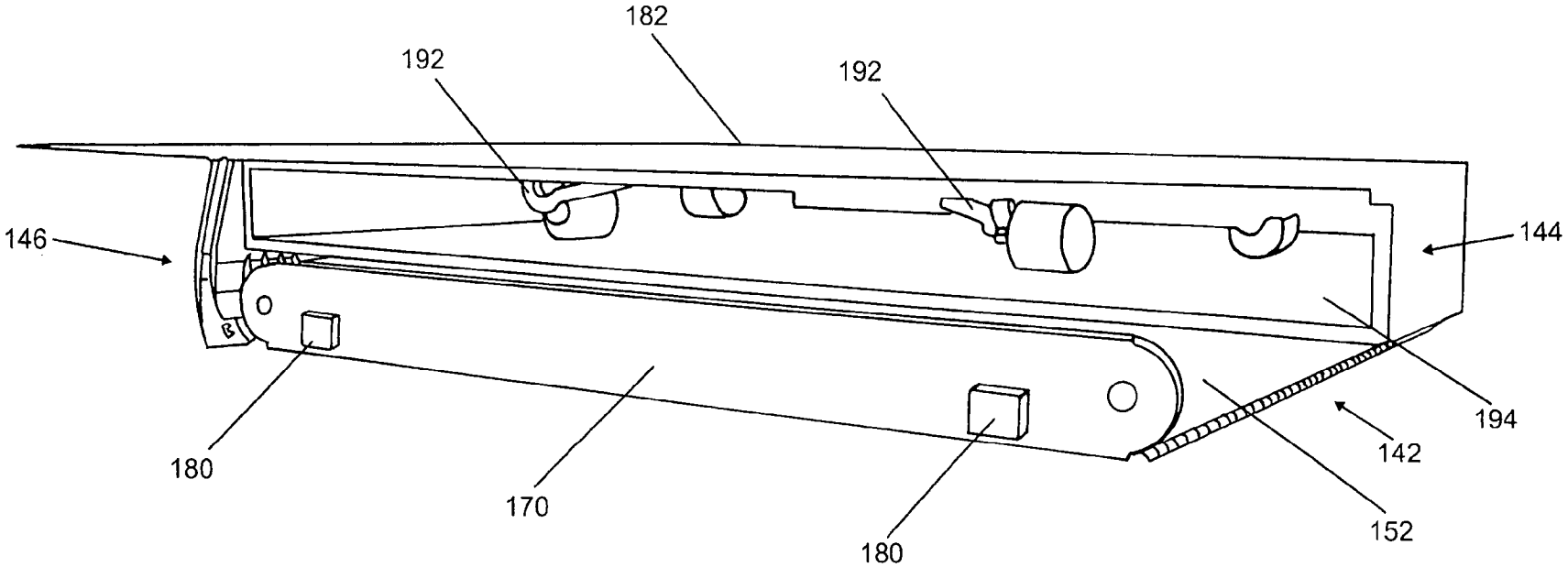

As per FIG. 10, a folding stage unit 144 is disposed above the vacuum handling unit 142. In the foregoing exemplary embodiment, the folding stage unit 144 according to FIG. 14 is configured as a rectangle and has a smooth surface. The folding stage unit 144 consists of or comprises a folding stage 182 extending parallel to the conveyor belt 152 of the vacuum handling unit 142 and a frame element 184 extending parallel to the conveyor belt 152, which frames the folding stage 182. The folding stage 182 possesses a smooth surface, which is structurally perforated to allow for the passage of air, i.e., the folding stage 182 has a bore array 186 for the passage of air or for the suctioning of the napkin 12. The folding stage 182 fixes the napkin 12 during the folding process through light suction. Preferably, the structurally perforated folding stage 182 is divided into at least four individual tiltable surface elements 182*a*, 182*b*, 182*c*, 182*d*. Between the individual tiltable rectangular surface elements 182*a*, 182*b*, 182*c*, 182*d* there are narrow slots 188, 190*a*, 190*b*, through which, as per FIG. 15, moveable holding elements 192 can enter the folding stage unit 144 from an area 194 located under the folding stage 182 depicted in FIG. 16. When retracted, the holding elements 192 are located in an area 194 disposed under the folding stage 182. If the holding elements 192 are activated, as shown in FIG. 15, they move out of the slots 188, 190*a*, 190*b* and fix the napkin 12 to the folding stage 182. The area 194 is operatively connected preferably to a vacuum generator 176, for example, by means of a flexible hose 178, whereby the vacuum generator can be the pressure-generating unit 176 of the vacuum handling unit 142.

Figure 17:
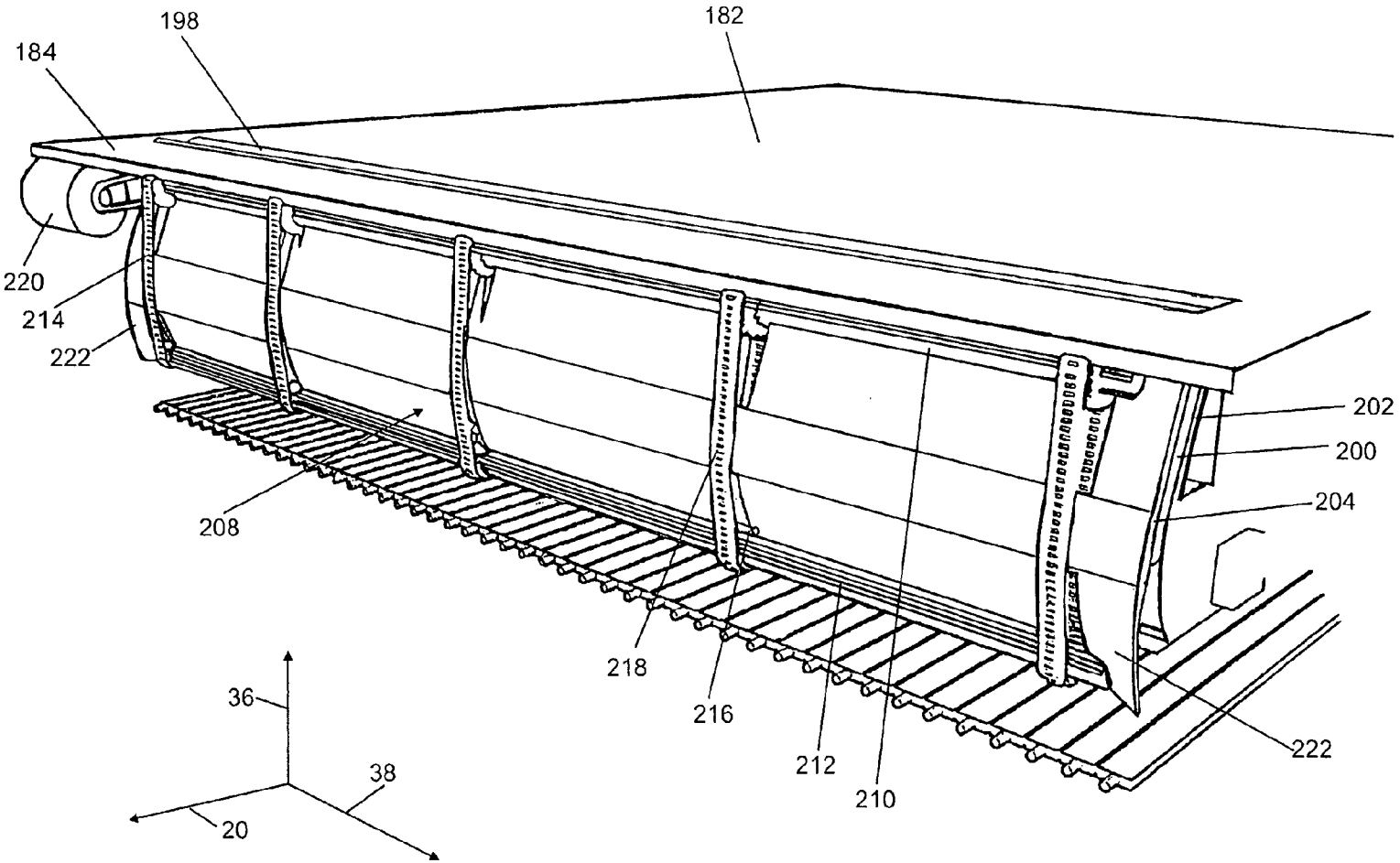
Figure 18:
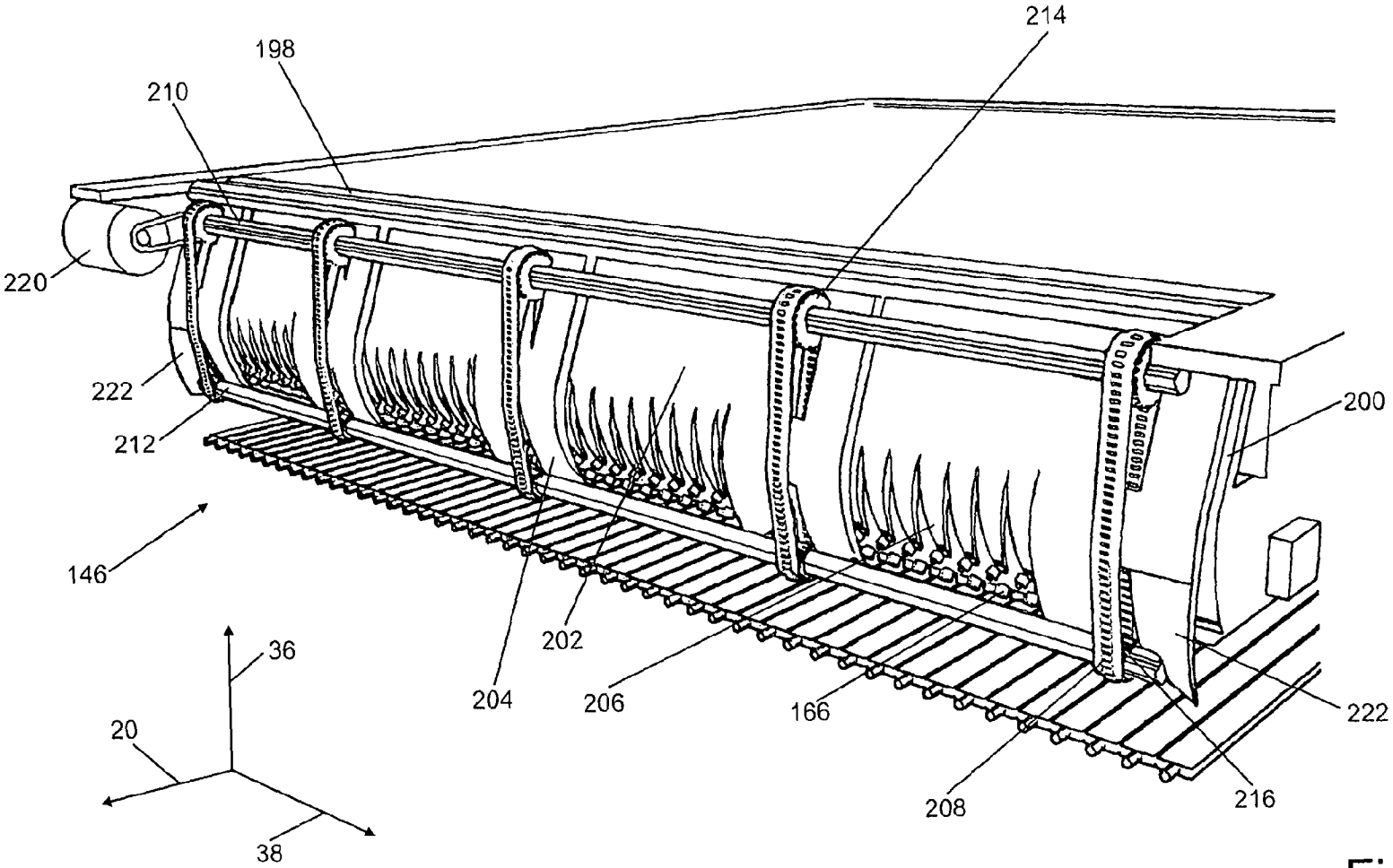

As per FIG. 10, the folding stage unit 144 is operatively connected to the vacuum handling unit 142 on one side of the folding stage unit 144 via the frame element 184 by means of a separation unit 146. The separation unit 146 as per FIG. 17 has in the frame element 184 a removal slot 198 along the transverse axis 38, which continues under this removal slot 198 as guide channel 200. The guide channel 200 is limited by an inner guide unit 202 facing the folding stage 182 and an outer guide unit 204 facing away from the folding stage 182. FIG. 18 shows the separation unit 146 with a cut-out outer guide unit 204, whereby one can see the inner guide unit 202. The inner guide unit 202 has a plane form along the transverse axis 38, which then runs out from the removal slot 198 at a tilt angle and, immediately next to the circular conveyor belt 152 of the vacuum handling unit 142, has a form radially configured toward the conveyor belt 152, the end of which has a comb-shaped structure with separating points 206. The separating points 206 serve to lift the napkin 12 from the air-permeable knobs 166 of the conveyor belt 152 of the transport unit 18, whereby the knobs 166 are configured exactly between the separating points 206 on the conveyor belt 152, i.e., the knobs 166 circulate with the conveyor belt 152 without touching the separating points 206. The outer guide unit 204 is disposed along the longitudinal axis 20 at a small distance from the inner guide unit 202. The separation unit 146 separates the napkin 12 from the conveyor belt 152, which is subject to a vacuum and transports it through the removal slot 198 upward to the folding stage 182.

Figure 19:
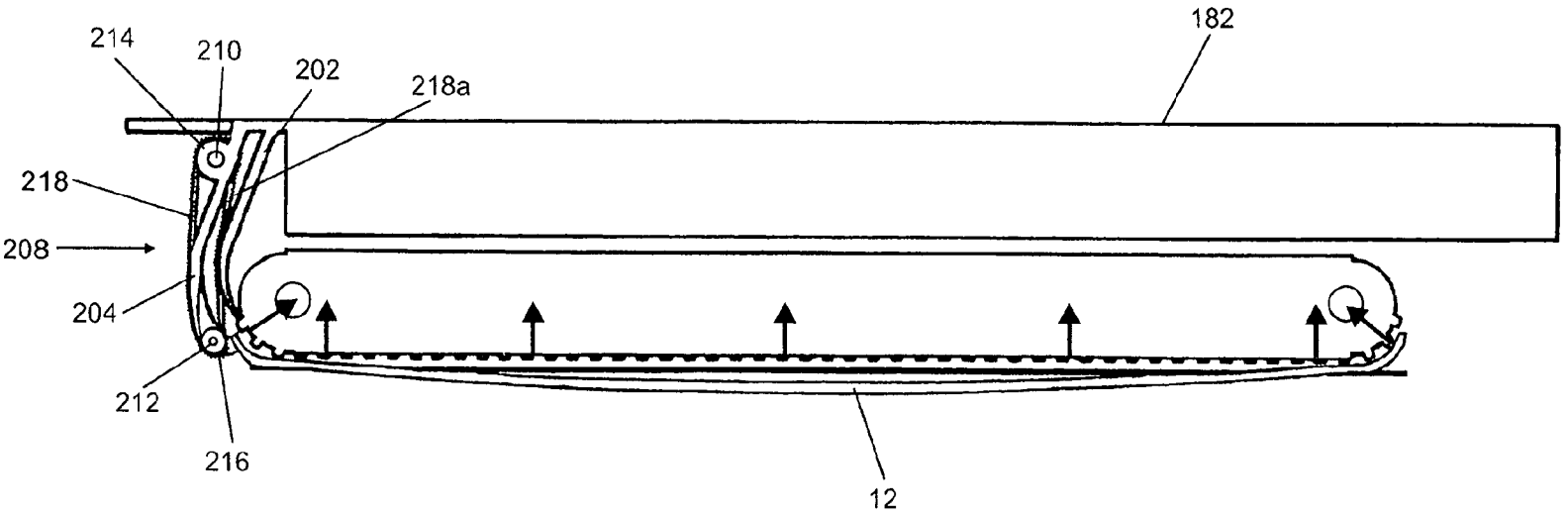
Figure 20:
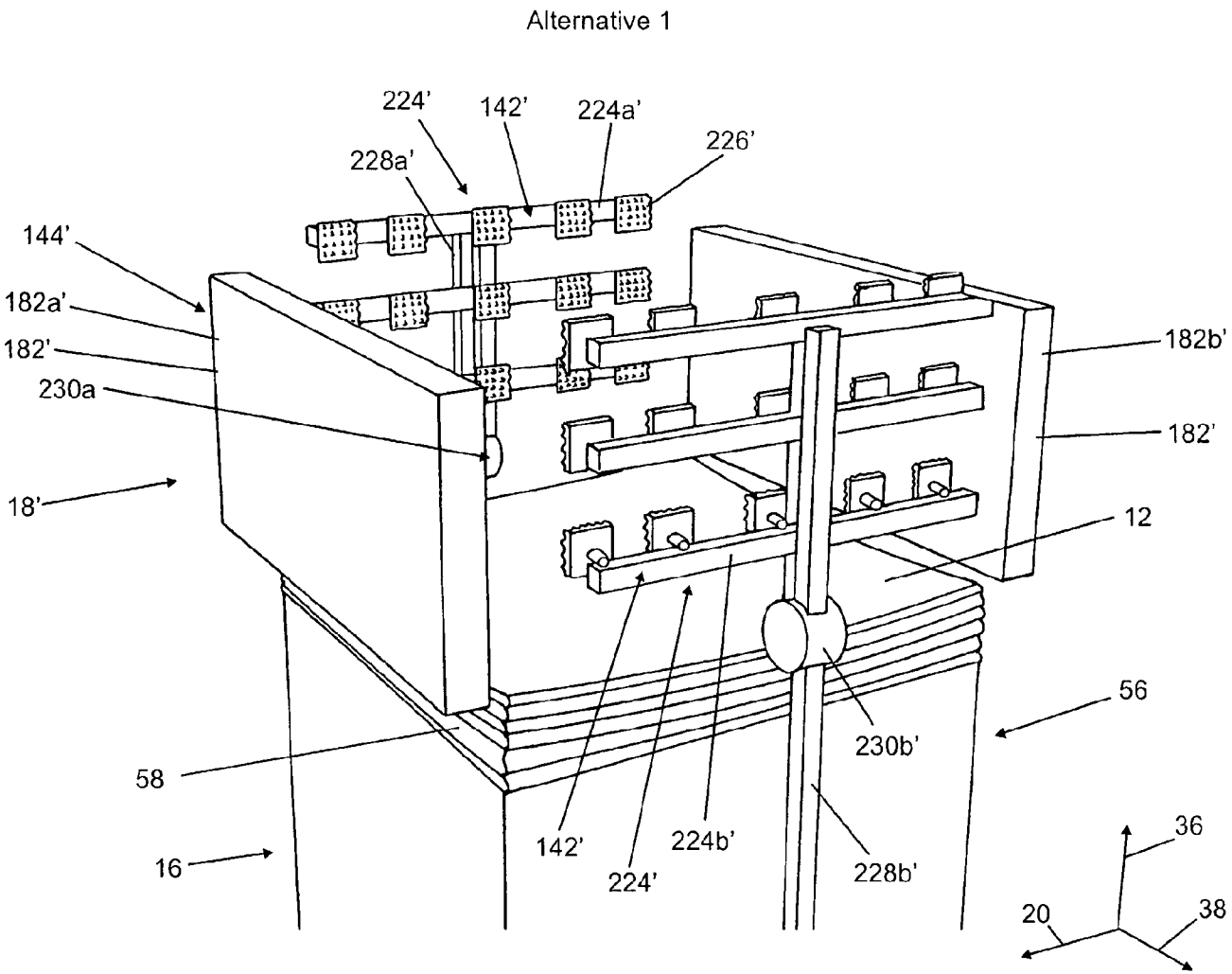

The separation unit 146 has several belt drives 208 in the form of a geodetic spindle 210 on the top running along the transverse axis 38, and a geodetic spindle 212 on the bottom running along the transverse axis 38, whereby the spindles 210, 212 are disposed in front of the guide channel 200 along the longitudinal axis 20. There are multiple drive wheels 214, spaced apart, disposed on the spindles 210, 212, whereby the drive wheels 214 of the spindle on top 210 are opposite the drive wheels 216 of the spindle on the bottom 212. The drive wheels 214 of the spindle on top 210 penetrate the outer guide unit 204 at least partially. Via two drive wheels 214, 216 each, disposed opposite each other, a belt 218 turns, which also at least partially penetrates the outer guide unit 204, whereby as per FIG. 19 the load strand 218*a* of the belt 218 is pressed against the inner guide unit 202 and thereby against the napkin 12. The belt drives 208 are provided with a drive 220 preferably disposed in the area of the rear side of the separation unit 146 as per FIG. 18, which preferably drives the spindle on top 210 via one of the drive wheels 214. The drive 220 is preferably configured as a step motor. The separation unit 146 has slanted guide surfaces 222 in the catchment area of the napkin 12, depicted in FIGS. 17 and 18, which makes it possible to align protruding edges of napkins 12.

In the operation of the napkin folding device, a napkin 12 is suctioned from a holding stack in the delivery unit 16 by the transport unit 18 via the vacuum handling unit 142, led through the separation unit 146 and transported to the folding stage unit. The conveyor belt 152 turns preferably clockwise and slides an edge of the napkin 12 into the separation unit 146. The napkin 12 is lifted by the separating points 206 of the knobs 166 of the conveyor belt 152 and then pulled by the belt 218 of the belt drive 208 upward through the removal slot 198 to the folding stage 182.

FIGS. 20 and 21*a* to 21*i* show a first alternative to the transport unit 18 of the exemplary embodiment. The alternative transport unit 18' is also disposed on top of the delivery unit 16. The alternative transport unit 18' has a folding stage unit 144' and a vacuum handling unit 142'. Both the folding stage unit 144' and the vacuum handling unit 142' are bipartite and are configured as pivotable or tiltable.

The tiltable vacuum handling unit 142' consists of or comprises a carrier framework 224' with suction elements 226' preferably configured as suction knob areas. The preferably rectangular carrier framework 224' is configured as bipartite, which means the carrier framework 224' has two parts 224*a*', 224*b*' of the same size. A first part 224*a*' of the carrier framework 224' is mounted on a first rod 228*a*' running along the vertical axis 36, which is pivotable 90° upward or downward by means of a joint 230*a*', as well as moveable upward or downward along the rod 228*a*'. A second part 224*h*' of the carrier framework 224' is housed on a second rod 228*b*' opposite the first rod 228*a*', which is pivotable 90° upward or downward by means of a joint 230*b*' as well as moveable upward or downward along the rod 228*b*'. Both parts 224*a*', 224*b*' of the carrier framework 224' pivot upward, so they create a surface extending parallel to the folding stage unit 144'. The pivotable folding stage unit 144' consists of or comprises a folding stage 182'. The preferably rectangular folding stage 182' is configured to be bipartite, i.e., the folding stage 182' has two parts 182*a*', 182*b*' of the same size. Both parts 182*a*', 182*b*' of the folding stage 182' are movably mounted along a circular path. Both parts 182*a*', 182*b*' of the folding stage 182' move downward, so they create a surface extending parallel to the shelf 58 of the magazine 56 of the delivery unit 16.

Figure 21A:
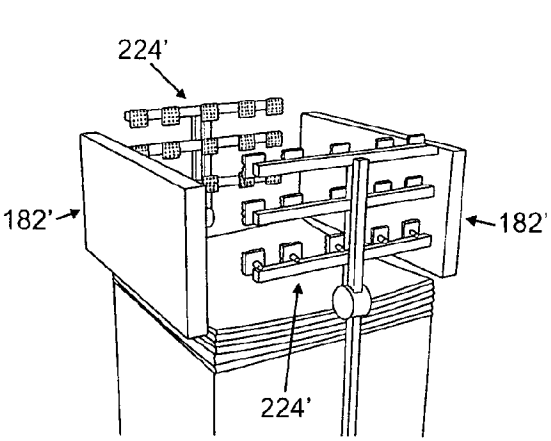
Figure 21B:
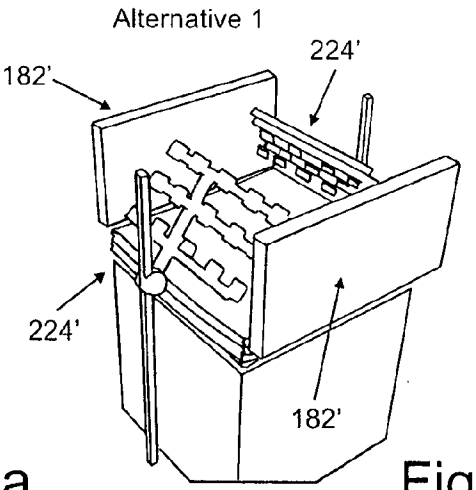
Figure 21C:
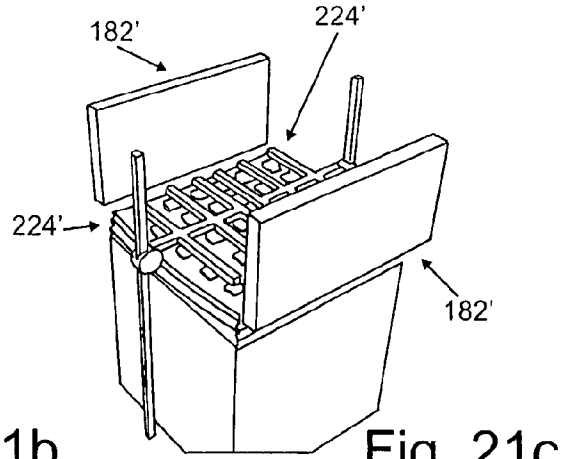
Figure 21D:
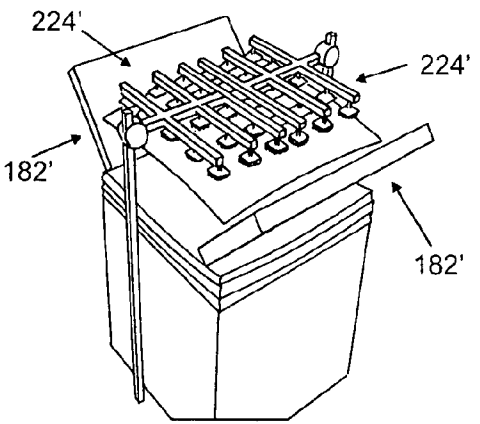
Figure 21E:
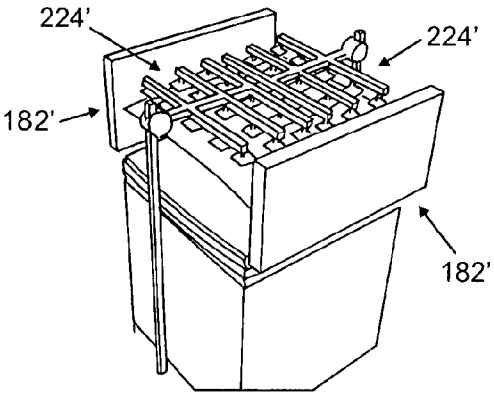
Figure 21F:
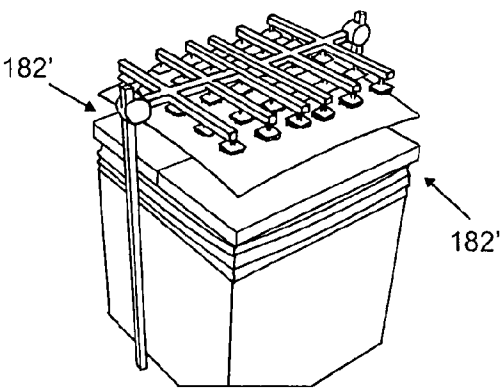
Figure 21I:
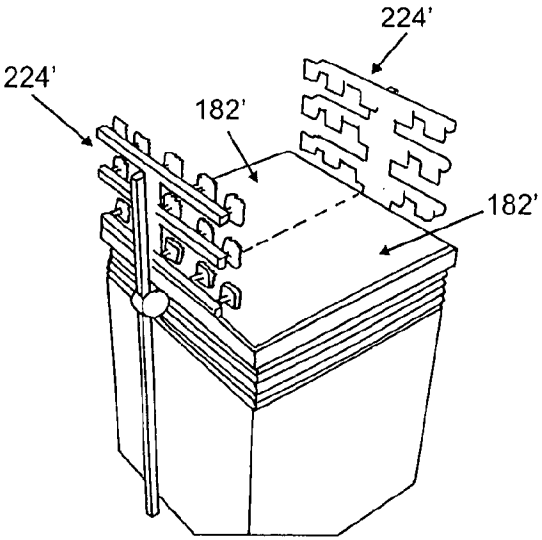
Figure 21H:
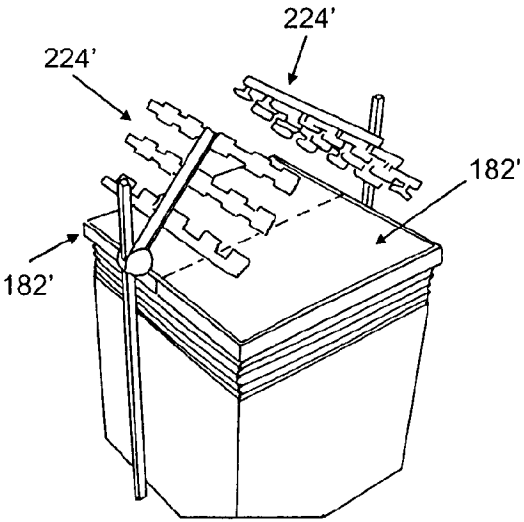
Figure 21G:
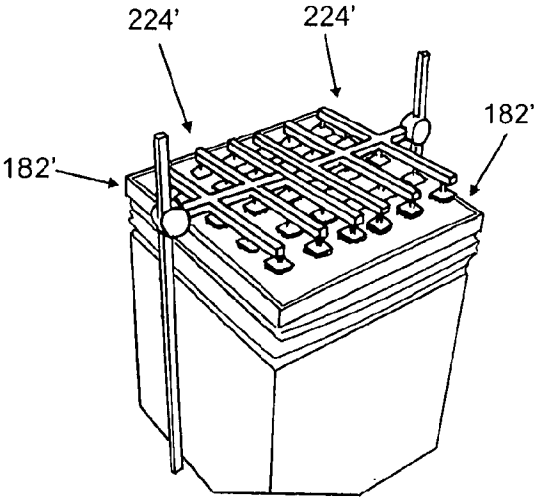

In an initial state of the transport unit 18', as per FIG. 21*a*, the carrier framework 224' and the folding stage 182' are found in an open state. In FIG. 21*b*, the parts 224*a*', 224*b*' of the carrier framework 224' are pivoted 90° inward. In FIG. 21*c* the carrier framework parts 224*a*', 224*b*' are fully pivoted inward and create a surface extending parallel to the shelf 58 of the magazine 56 of the delivery unit 16. In FIG. 21*d*, the napkin 12 suctioned by the carrier framework 224' is moved upward along the rods 228', 230' along the vertical axis 36. In FIG. 21*e* the folding stage parts 182*a*', 182*b*' are merged along the circular path under the carrier framework 224'. In FIG. 21*f*, the folding stage 182' is located underneath the carrier framework 224' with the suctioned napkin 12. In FIG. 21*g* the carrier framework 224' is moved downward along the rods 228, 230, so that the napkin 12 can be positioned on the folding stage 182'. Next, as per FIG. 21*h*, the carrier framework parts 224*a*', 224*b*' are pivoted outward again until they have reached the initial state, as per FIG. 21*i*.

FIGS. 22*a* to 22*e* show a second alternative to the transport unit 18 of the exemplary embodiment. The alternative transport unit 18" is also disposed along the vertical axis 36 over the delivery unit 16. The alternative transport unit 18" has a folding stage unit 144" and a vacuum handling unit 142", whereby the folding stage unit 144" is disposed near the delivery unit 16 with the magazine 56 containing the shelves 58. The folding stage unit 144" has a folding stage 182", which extends on the same level as the shelves 58. The vacuum handling unit 142" is preferably mounted parallel to units 16, 144" and is movable along a vertical axis 36 upward or downward by means of a rail system 232" over the delivery unit 16 and the folding stage unit 144". The vacuum handling unit 142" consists of or comprises a carrier framework 224" preferably with suction elements 226" configured as suction knob surfaces. The carrier framework 224" extends parallel to the shelves 58 of the delivery unit 16 and the folding stage 182".

Figure 22A:
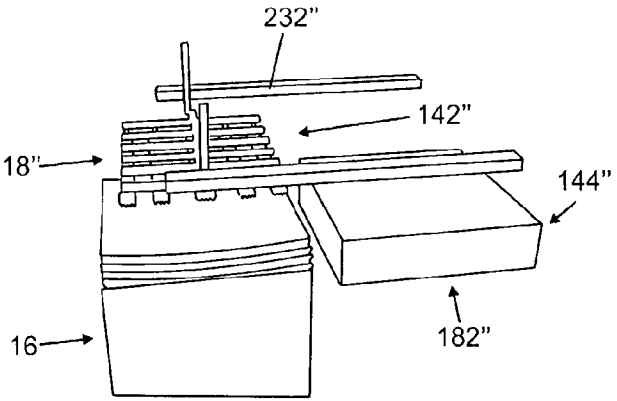
Figure 22B:
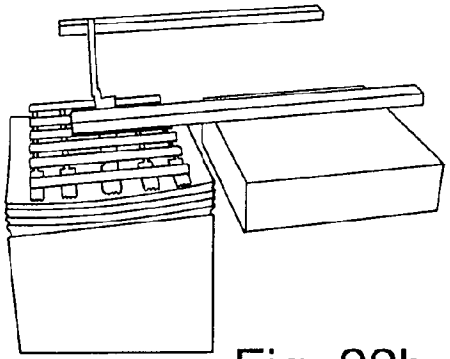
Figure 22C:
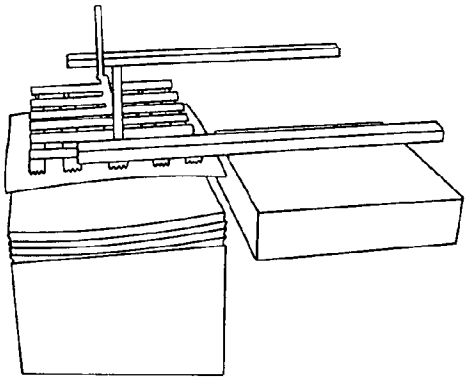
Figure 22D:
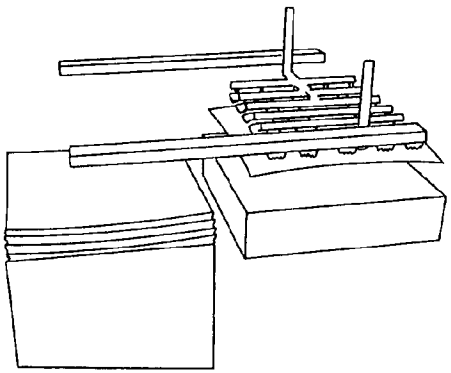
Figure 22E:
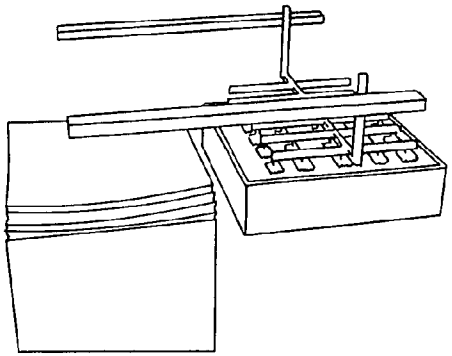

In an initial state of the transport unit 18" as per FIG. 22*a*, the carrier framework 224" is located directly over the magazine 56 of the delivery unit 16. In FIG. 22*b*, the carrier framework 224" is lowered along the vertical axis 36 downward to the uppermost shelf 58 of the magazine 56. In FIG. 22*c*, the carrier framework 224" is moved back up with the napkin 12, which has been suctioned up in the meanwhile, and in FIG. 22*d* thrust over the folding stage 182" via the rail system 232". In FIG. 22*e*, the carrier framework 224" is lowered with the suctioned napkin 12 until the napkin 12 can be positioned on the folding stage 182". Afterward, the carrier framework 224" is moved back again to its initial position as per FIG. 22*a*.

FIGS. 23*a* to 23*f* show a third alternative to the transport unit 18 of the exemplary embodiment. The alternative transport unit 18''' consists of or comprises a vacuum handling unit 142''' and a folding stage unit 144'''. The alternative transport unit 18''' is disposed along the vertical axis 36 over the delivery unit 16. The transport unit 18''' is movably mounted on two rods 228''' opposite each other running along the vertical axis 36. The transport unit 18''' is able both to move upward and downward along the rods 228''' and to turn around an axis 234''' running parallel to a shelf 58 of the magazine 56 of the delivery unit 16. The vacuum handling unit 142''' consists of or comprises preferably a rectangular carrier framework 224''' preferably with suction elements 226" configured as suction knob surfaces.

A folding stage unit 144''' consisting of or comprising a folding stage 182''' is fixed to the vacuum handling unit 142''' in such a way that the folding stage 182''' extends parallel to the carrier framework 224''' of the vacuum handling unit 142'''. Fixing the folding stage 182''' to the carrier framework 224''' is carried out via the suction elements 226''', which penetrate the folding stage 182'''.

Figure 23A:
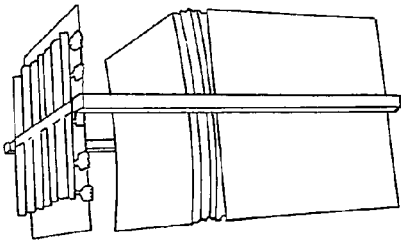
Figure 23B:
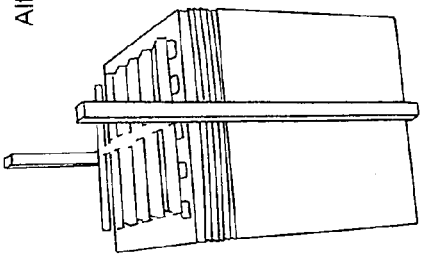
Figure 23C:
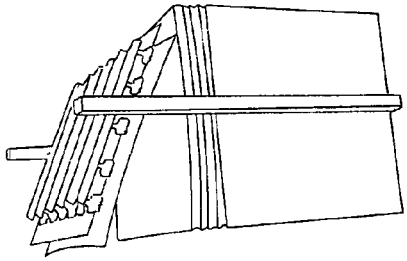
Figure 23D:
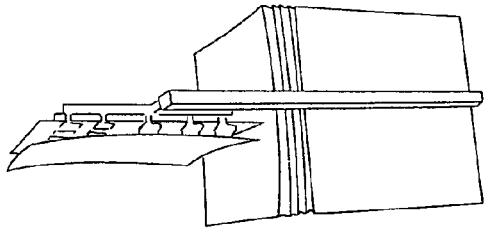
Figure 23E:
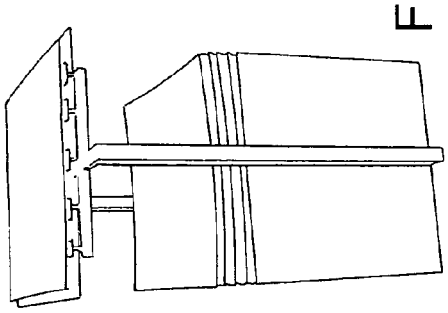
Figure 23F:
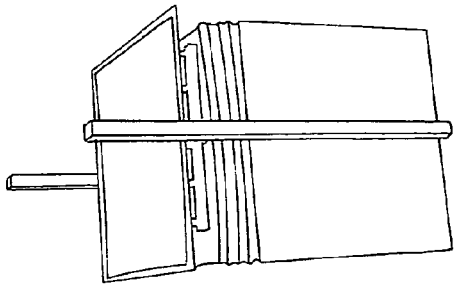

In an initial state of the transport unit 18''' as per FIG. 23*a*, the carrier framework 224''' is located on an upper end of the rods 228''' and extends parallel to an uppermost shelf 58 of the magazine 56 of the delivery unit 16, whereby the folding stage 182''' fixed to the carrier framework 224''' is facing the shelf 58. In FIG. 23*b*, the carrier framework 224''' along with the folding stage 182''' is lowered downward along the rod 228''' until the suction elements 226''' can suction up a napkin 12 lying on the shelf 58. In FIGS. 23*c* to 23*e*, the carrier framework 224''' with the folding stage 182''' and the napkin 12 which has been suctioned up is moved back up along the rods 228''' and is simultaneously turned around the axis 234''' until the carrier framework 224''' has again arrived at the upper end of the rods 228''', whereby the folding stage 182''', due to the 180° rotation, is now positioned facing away from the delivery unit 16. In FIG. 23*f*, the carrier framework 224''' with the napkin 12 which has been suctioned up on the folding stage 182''' is lowered until the napkin 12 can be processed by the folding unit 10.

The folding unit is provided by means of the transport unit 18 and particularly by means of the folding stage 182 of the transport unit 18. As per FIG. 1, the folding unit 10 is configured as a cuboid which is closed except for one bottom and one front 238, whereby the front 238 is movable via a door 30. By means of the open bottom of the cuboid, the folding stage 182 and the folding unit 10 are operatively connected. Preferably, the door 30 is formed from a transparent material and the folding process of the napkin 12 can be observed.

Figure 24:
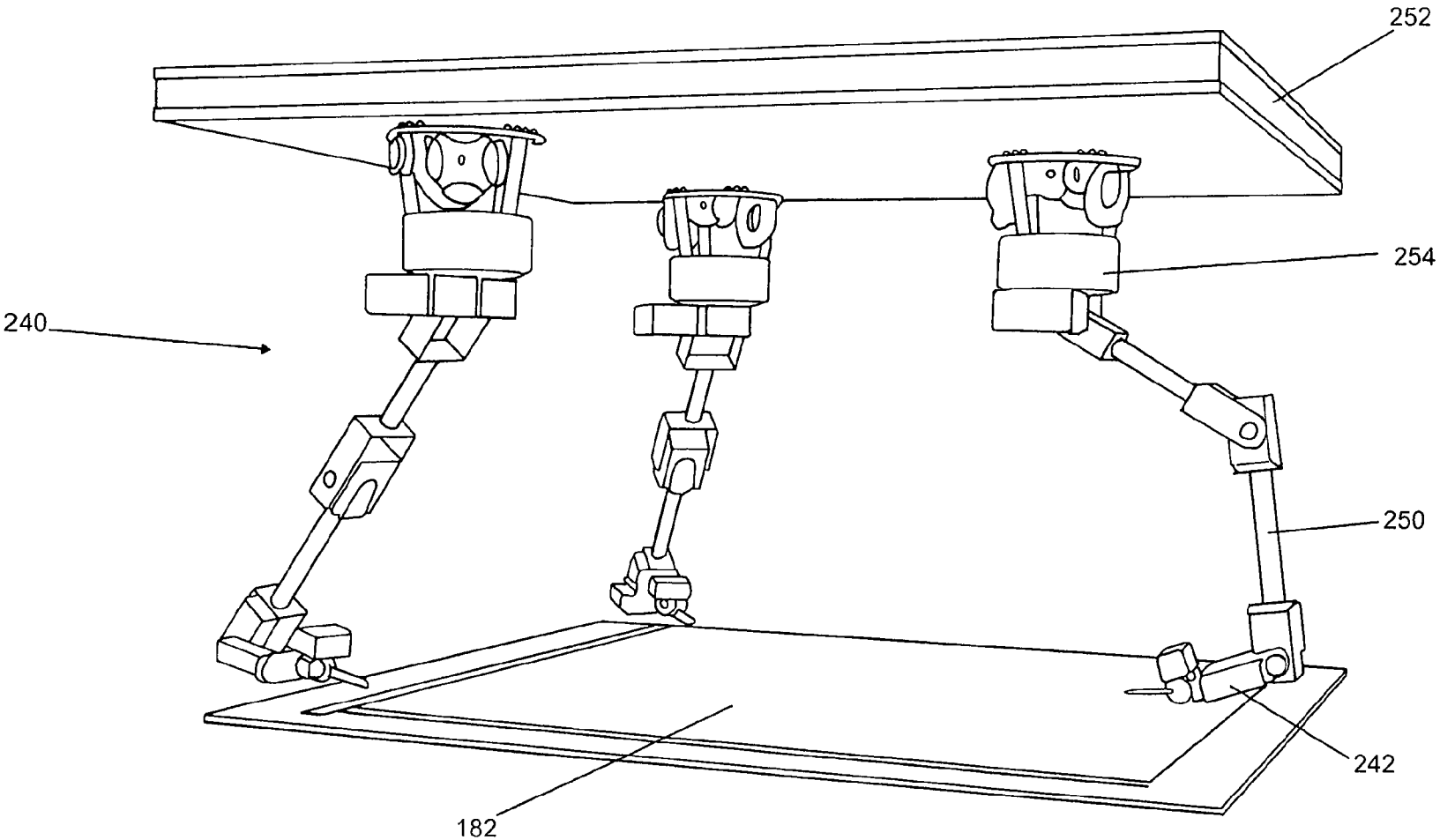
Figure 25:
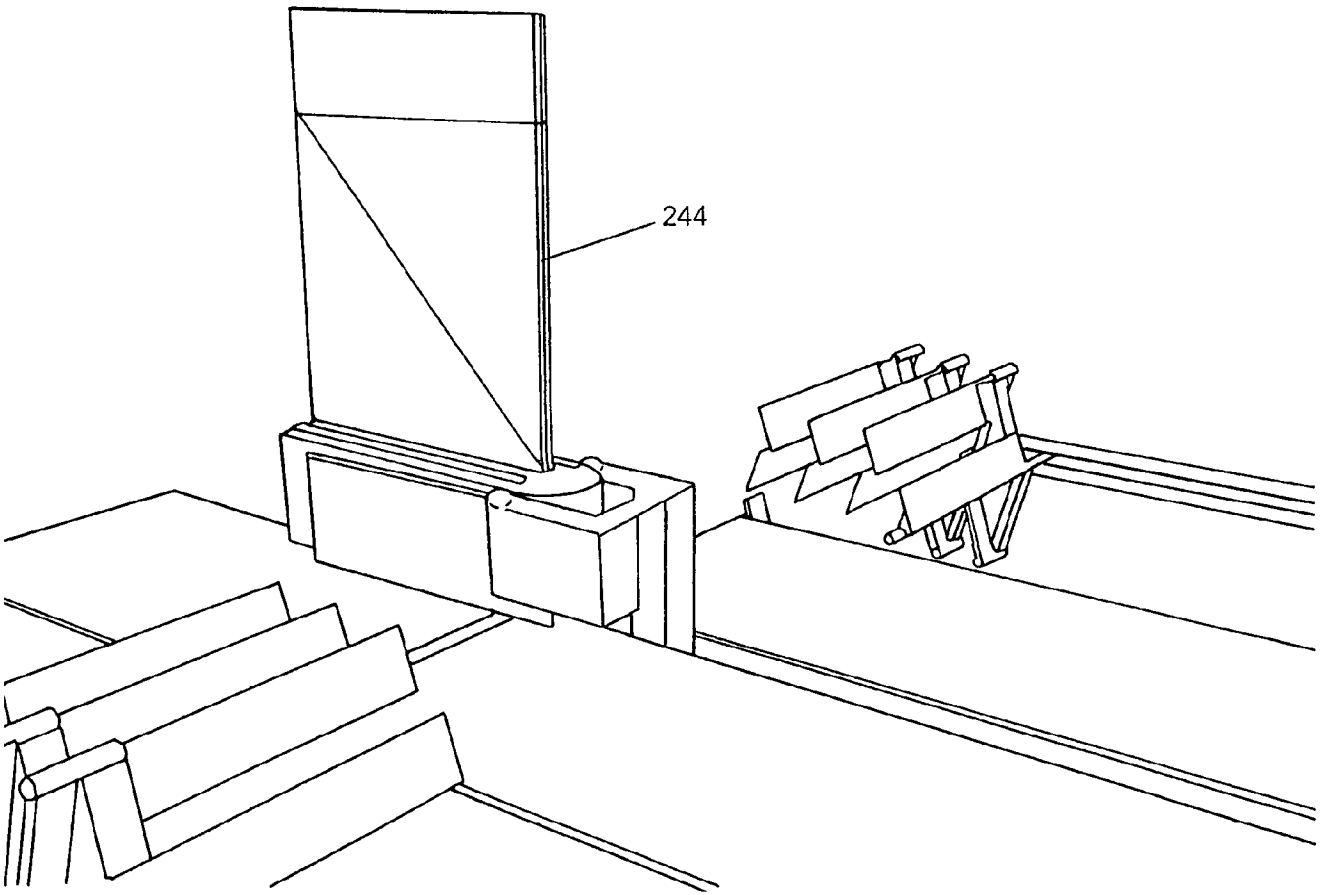
Figure 26:
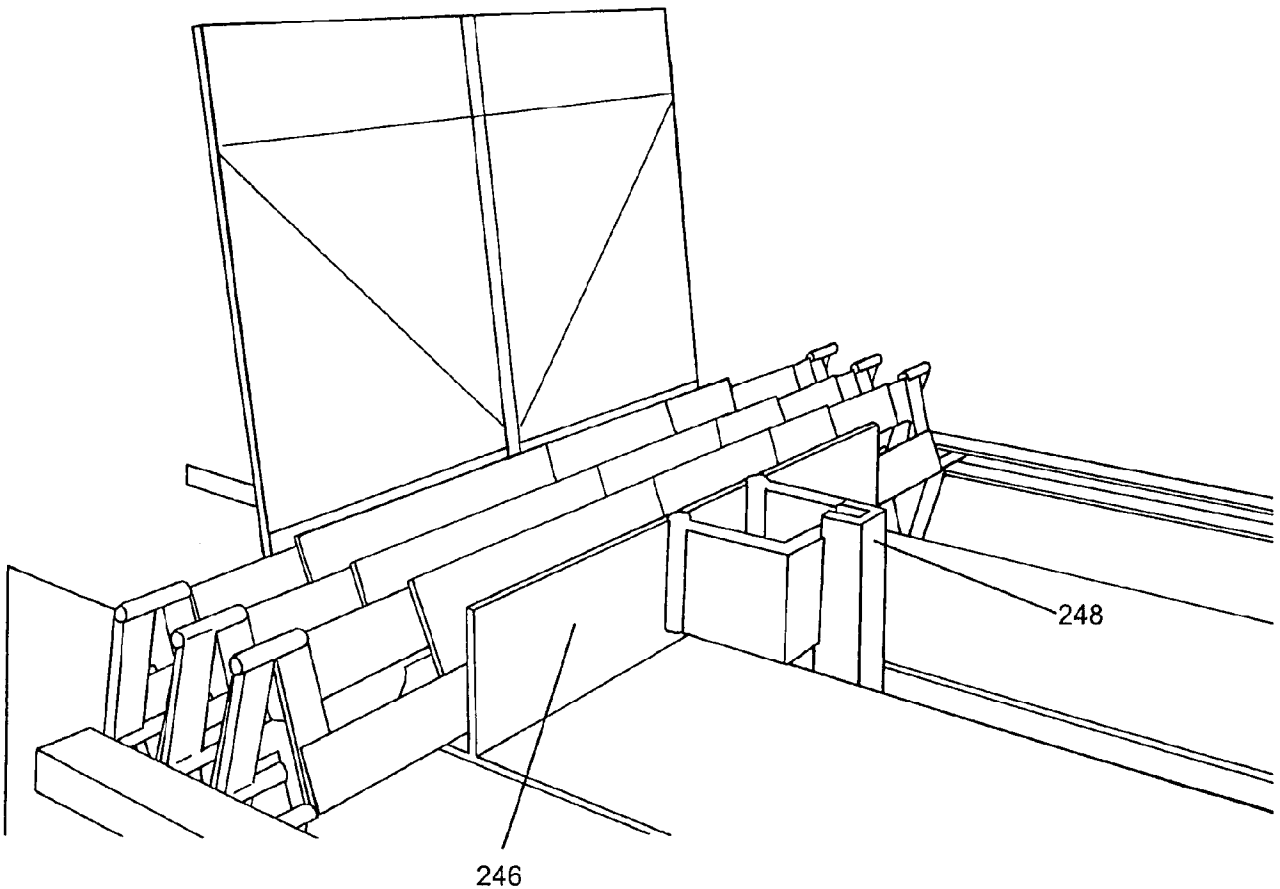

As depicted in FIG. 24, a robotic grip system 240 is disposed in the cuboid, which has different working parts 242, 244, 246. The grip system drive can be hydraulic, mechanical, pneumatic, or electrical. The working parts 242, 244, 246, 248 can, for example, be a grip 242 as per FIG. 24, which parts are available as one-finger, two-finger or multiple-finger grips in rigid, rigid-articulated, or elastic embodiments, whereby the grips 242 are preferably fixed on the robotic arms 250. As is depicted in FIG. 24, the robotic arms 250 are held on one of the panels 252 disposed opposite the folding stage 182 via guide systems 254, which make possible both rotational movements and linear movements of the robotic arms 250 or the grips 242. Geometrical bodies 244 as per FIG. 25 can also be provided as other working parts, on which the napkin 12 to be folded is placed. Furthermore, the working parts can be holding elements 246 and/or support elements 248 as per FIG. 26 on the folding stage 182. In addition to these holding elements 246 of the grip system 240, the folding stage 182 has a bore array 186, which fixes the napkin 12 through light suction during the folding process carried out by the grip system 240 on the folding stage 182. While, for example, the robotic grip system 240 folds one side of the napkin 12, the other side of the napkin stays in place, i.e., the other side of the napkin 12 is not moved. This guarantees that the corners or the sides of the napkin 12 are not moved during the folding process, but rather stay in their prescribed place on the folding stage 182. The folding stage 182 also has narrow slots 188, 190*a*, 190*b*, through which the movable holding elements 192 can enter the folding stage unit 144 from the area 194 located under the folding stage 182. Here, the folding stage 182 serves additionally to hold unfolded napkins 12 and to accommodate and integrate holding elements 192 and/or tilting mechanisms for holding elements 192. Thereby the folding stage 182 functions as a supporting complement to the robotic grip system 240.

Figure 27:
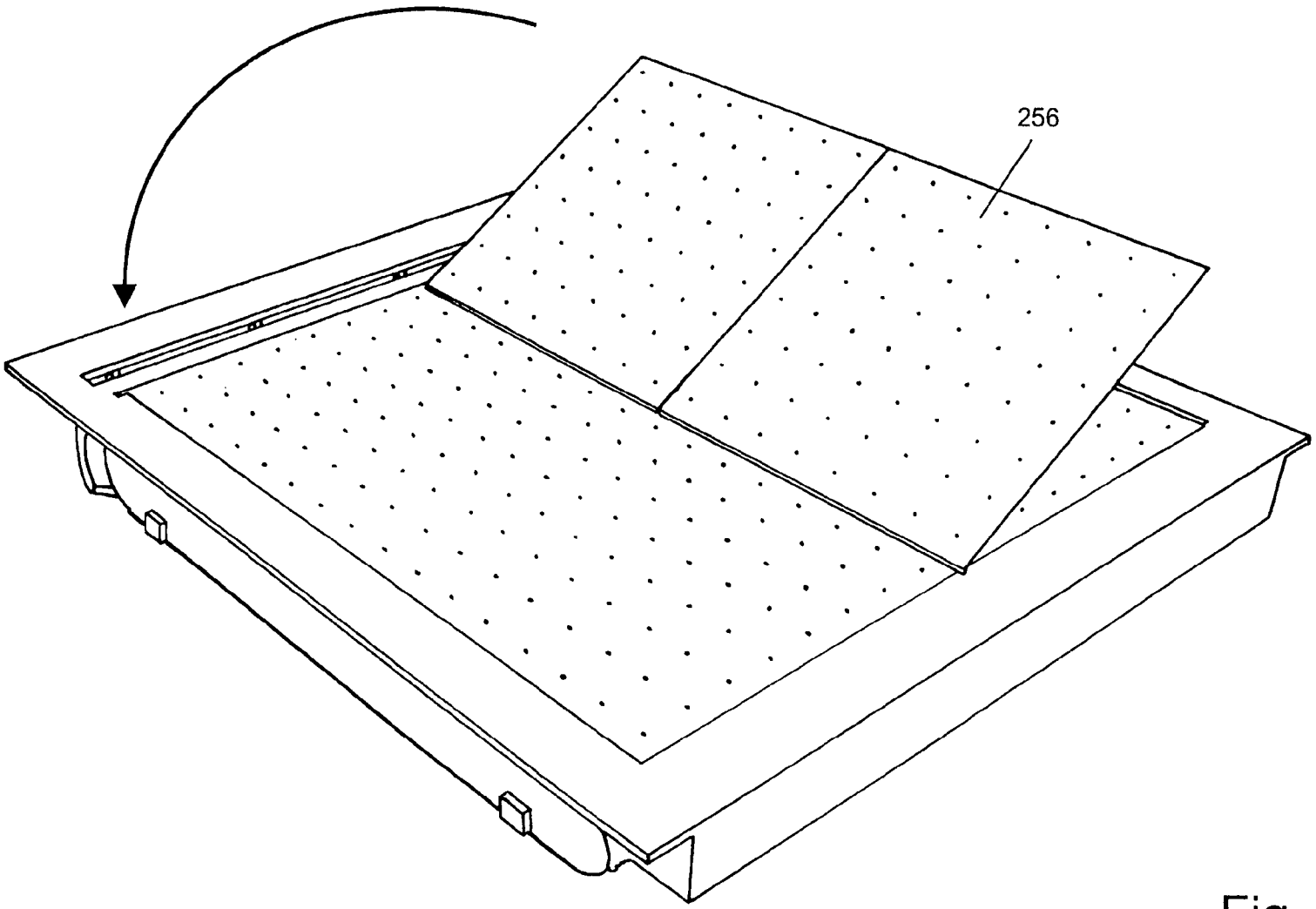
Figure 28:
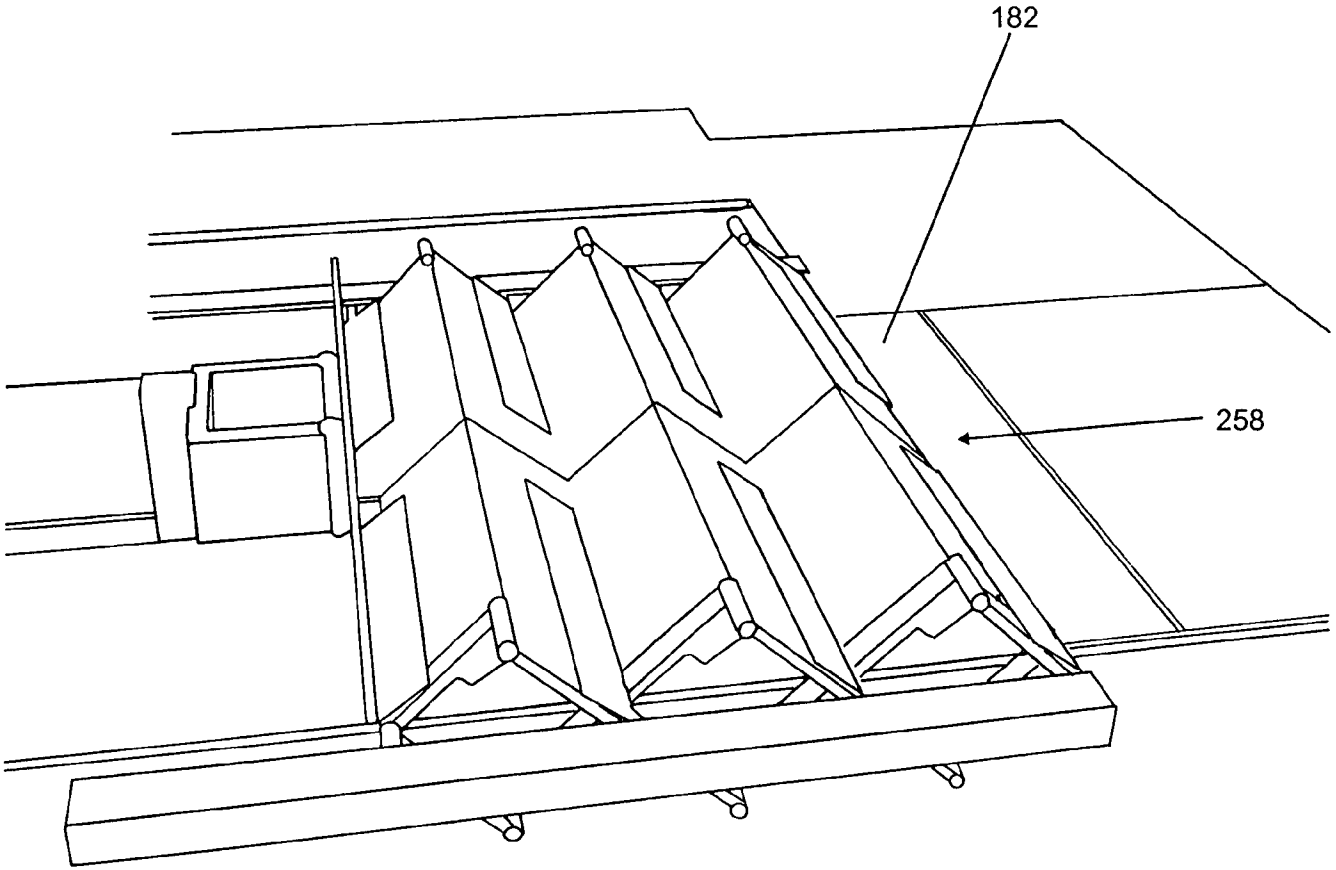

Hinged elements 256 can be provided as per FIG. 27, which, for example, can make a simple folding of a napkin possible, or sliding elements 258 too, as per FIG. 28, which make it possible to fold a napkin 12 in a zigzag pattern. In particular, other working parts can be provided which might seem sensible to an expert. The grip system 240 is configured in such a way that, for example, the napkin folds depicted in FIGS. 29*a* to 29*l* are producible.

Figure 29A:
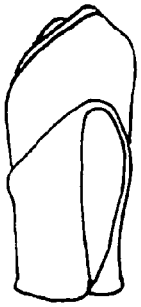
Figure 29B:
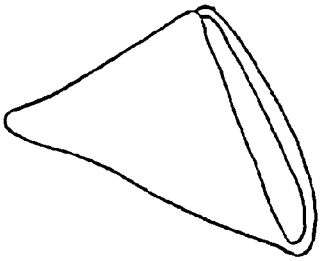
Figure 29C:
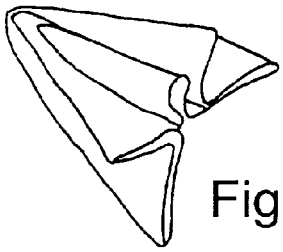
Figure 29D:
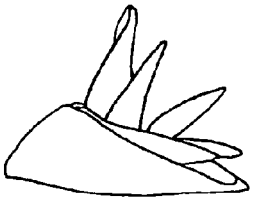
Figure 29E:
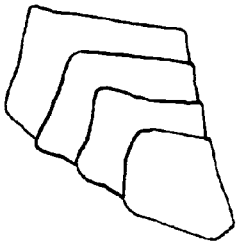
Figure 29F:
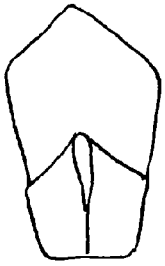
Figure 29G:
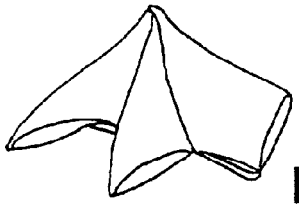
Figure 29H:
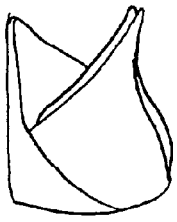
Figure 29I:
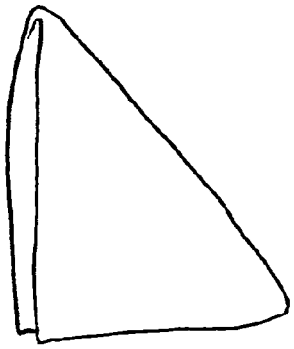
Figure 29J:
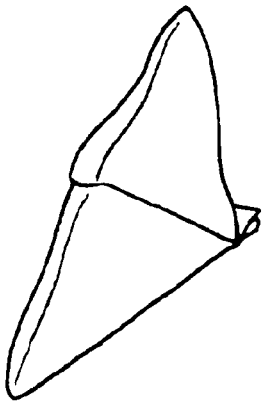
Figure 29K:
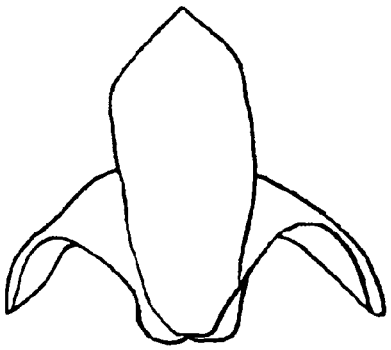
Figure 29L:
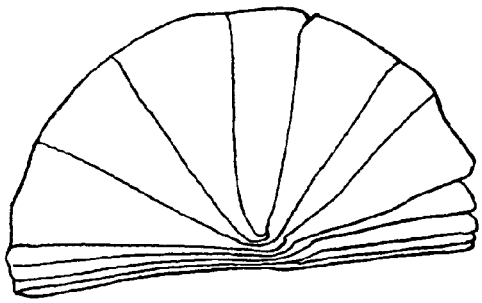

FIG. 29*a* shows a so-called rosebud napkin fold, which is producible, for example, with two arms, a two-point grip (also called a two-fingered grip) and a support means on the base. FIG. 29*b* shows a so-called pyramid napkin fold, which is producible by means of two arms and a two-point grip. An arrow-head-shaped napkin fold in FIG. 29*c* can be produced by means of two arms, a two-point grip of a conical form and a ruler. Additionally, a sophisticated A [sic] boat-shaped napkin fold such as in FIG. 29*d* can be produced by means of three arms, a two-point grip and a ruler. Gripping must take place between folded layers in this case. A diamond napkin fold in FIG. 29*e* can be produced by means of two arms, a two-point grip, two corner clamps, a flat form and a lateral folder as well as support holders on the base. FIG. 29*f* shows a conical napkin fold, which requires two arms, a two-point grip, a flat form and a lateral folder, a preferably heated ruler grip and support holders on the base. A French napkin fold as in FIG. 29*g* can be produced by means of two arms, a two-point grip, a ruler grip, and support holders on the base. A cardinal's hat napkin fold in FIG. 29*h* can be produced by means of three arms, a two-point grip, a ruler grip, and support holders on the base. FIG. 29*i* shows a sail napkin fold, which can be produced by means of two arms, a two-point grip, a ruler grip and support holders on the base. If desired, it is quite simple for the fold to be placed vertically by the staff while serving. A slide napkin fold such as in FIG. 29*j* can be produced with two arms, a two-point grip, a corner clamp, a ruler grip and support holders on the base. If desired, it is quite simple for the fold to be placed vertically by the staff while serving. A crown napkin fold such as in FIG. 29*k* can be produced by means of two arms, a two-point grip, a cylindrical form, and support holders on the base. A standing fan napkin fold such as in FIG. 29*l* can be produced by means of three arms, a two-point grip, and a ruler grip, as well as support holders on the base.

Figure 30:
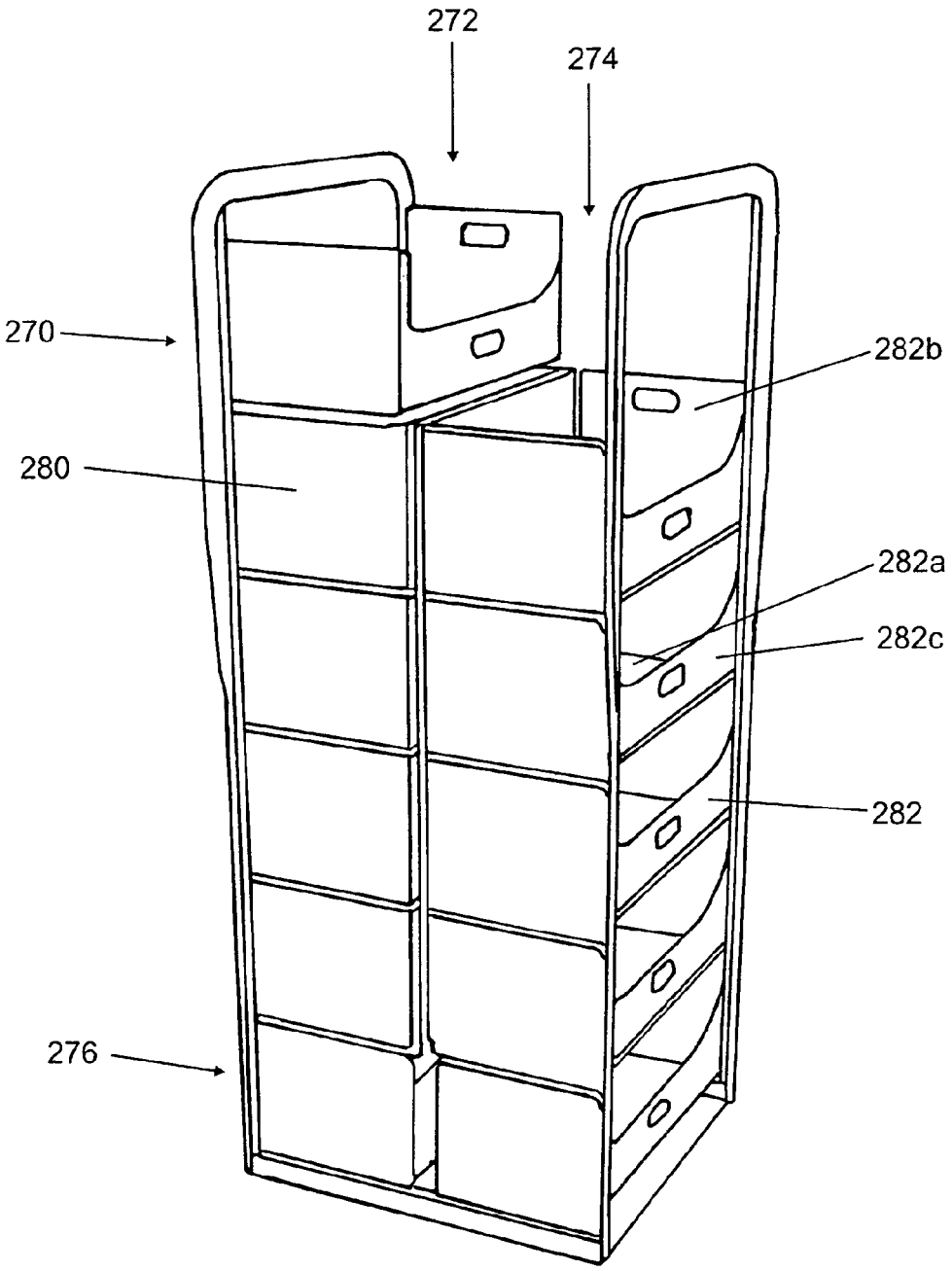

As depicted in FIG. 1, the folded napkins 12 arrive from the folding unit 10 via the grip system 240, or an alternative that might seem sensible to an expert, in the storage unit 14. The storage unit 14 is likewise preferably configured as a cuboid standing on a base part, which has an open side 260, 262 as well as a closed rear wall 264, a closed front 266 and a closed top 268. Via the open side 262, the storage unit 14 is connected to the folding unit 10. The storage unit 14 is configured according to the paternoster principle. In the cuboid as per FIG. 30 a gantry 270 is disposed with two shafts 272, 274 disposed side by side along the longitudinal axis 20 of the napkin folding device and running along the vertical axis 36 of the napkin folding device, whereby the shafts 272, 274 in a lower area 276 and in an upper area 278 are connected with each other. The shafts 272, 274 have guides, not depicted here, running along the vertical axis 36, and guides running along the longitudinal axis 20, in which cartridges 280 are drivable in a controlled circular operation in the shafts 272, 274. By means of the guides running along the vertical axis 36, the cartridges 280 move either upward or downward in the respective shafts 272, 274. In the upper area 278 and the lower area 276 of the shafts 272, 274 the cartridges 280 are moved by means of the guides running along the longitudinal axis 20 to the other shaft 272 or 274, respectively. In the foregoing exemplary embodiment a total of eleven cartridges are provided. In order for a circular operation of the cartridges 280 to be possible, there are five cartridges 280 in one of the shafts 272 or 274 when the storage unit is at rest, and in the other shaft 272 or 274 there are six cartridges 280. Drawers 282 in the cartridges 280 are retractable. The drawers 282 have a base 282*a* and four side parts 282*b*, 282*c*, in which a recess 284 is provided which is serviceable as a handgrip. Both side parts 282*c* disposed opposite each other along the longitudinal axis 20 have a lower height than the other two side parts 282*b*, in order to provide good access from the folding unit 10 into the inside of the drawer 282. The storage unit 14 has a control unit, which is not visible here, by means of which the circular operation of the drawers 282 exerts quantity-dependent control. In the operation, the uppermost drawer 282 neighboring the folding unit 10 is stocked with folded napkins. The circular operation of the drawer 282 is controlled by means of a counting mechanism and a new empty drawer 282 is delivered depending on the number of folded napkins 12 in this drawer 282.

Preferably, the gantry 270 of the storage unit 14 is housed on rails not shown here and can be moved or pulled out, preferably fully, from the housing 26 of the napkin folding device along the longitudinal axis 20, which serves mainly for purposes of maintenance and less so for removing the folded napkins 12 stored in the drawers 282.

Figure 31:
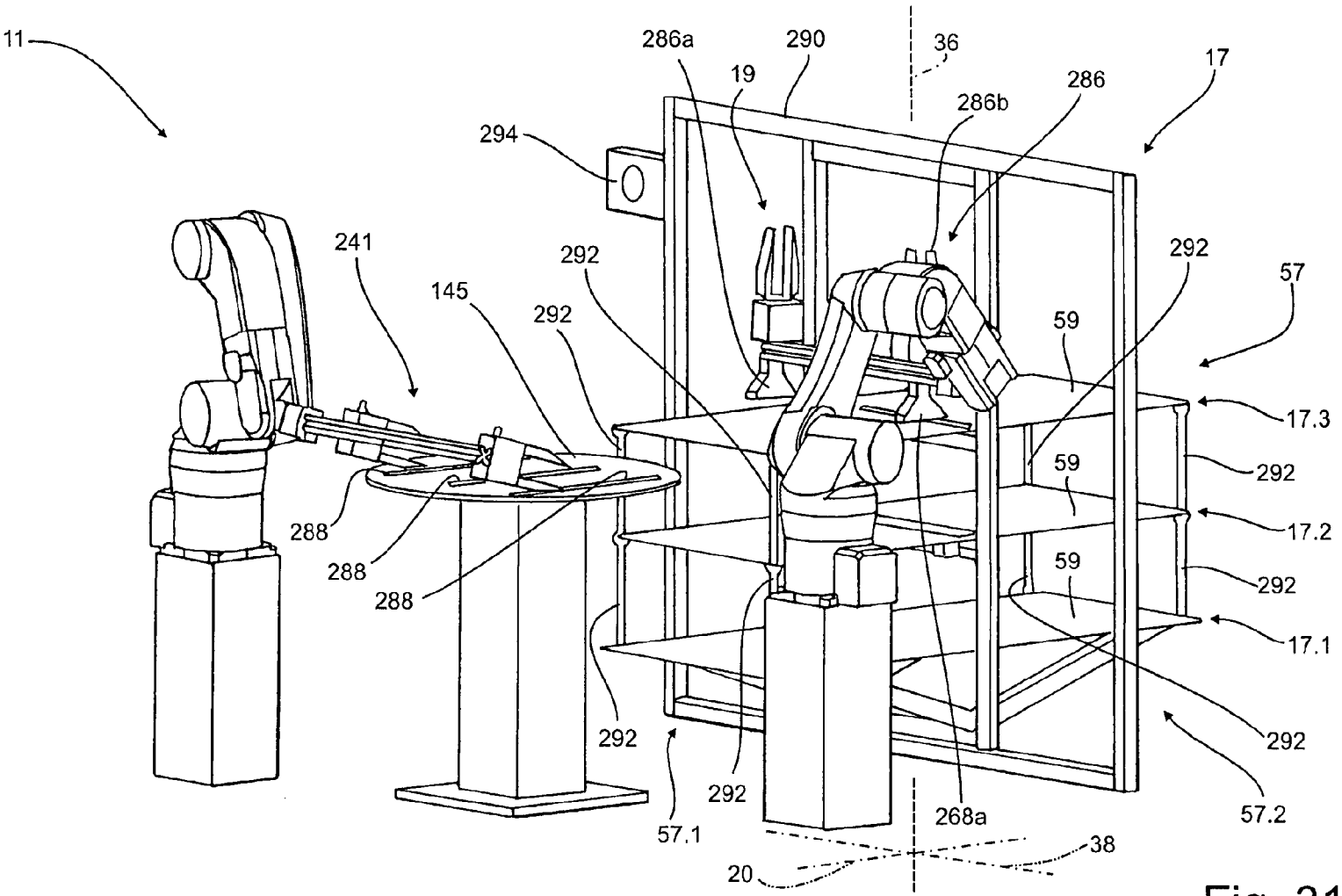
FIG. 31 A delivery unit in a first alternative embodiment, a transport unit in a fourth alternative embodiment, and a folding unit in a first alternative embodiment in a perspective representation of a partially displayed napkin folding device.

FIG. 31 shows a delivery unit 17 in a first alternative embodiment, a transport unit 19 in a fourth alternative embodiment and a folding unit 11 in a first alternative embodiment, in a perspective representation of a partially depicted napkin folding device, whereby these units 11, 17, and/or 19 are each configured to interact with one or multiple components of the napkin folding device. This means that all the listed components 10, 11; 14; 16, 17; 18, 19 are combinable with each other. As already mentioned above, the units 10, 11; 14; 16, 17; 18, 19 of the napkin folding device are operatively connected or are functionally linked, which means the delivery unit 16, 17 is coupled with the transport unit 18, 19, which in turn is linked to the folding unit 10, 11, which in turn is coupled with the storage unit 14. That means each individual napkin 12 passes through the four units 10, 11; 14; 16, 17; 18, 19 of the napkin folding device.

Figure 32:
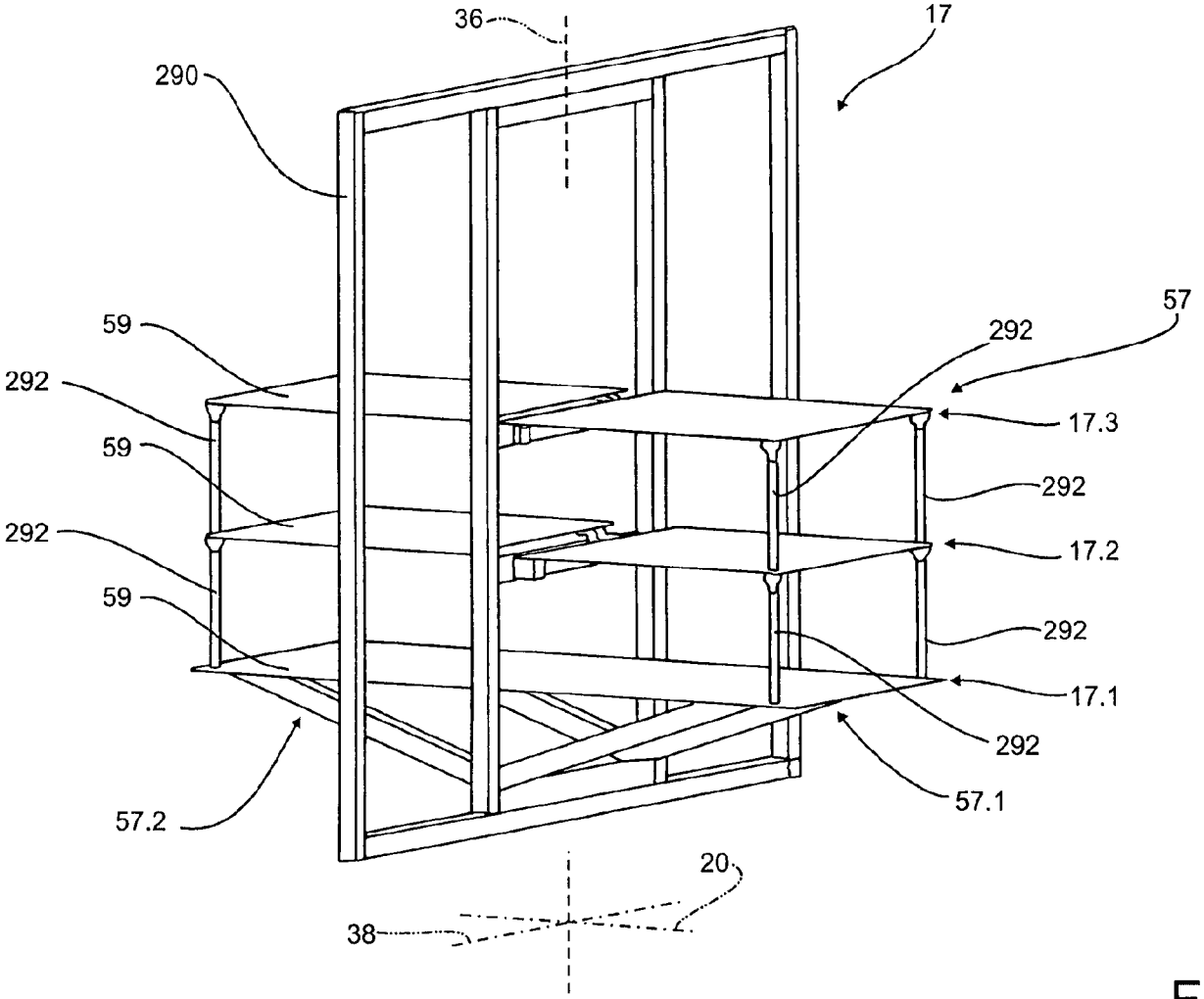
FIG. 32 The delivery unit in the first alternative embodiment in a perspective representation.
Figure 33:
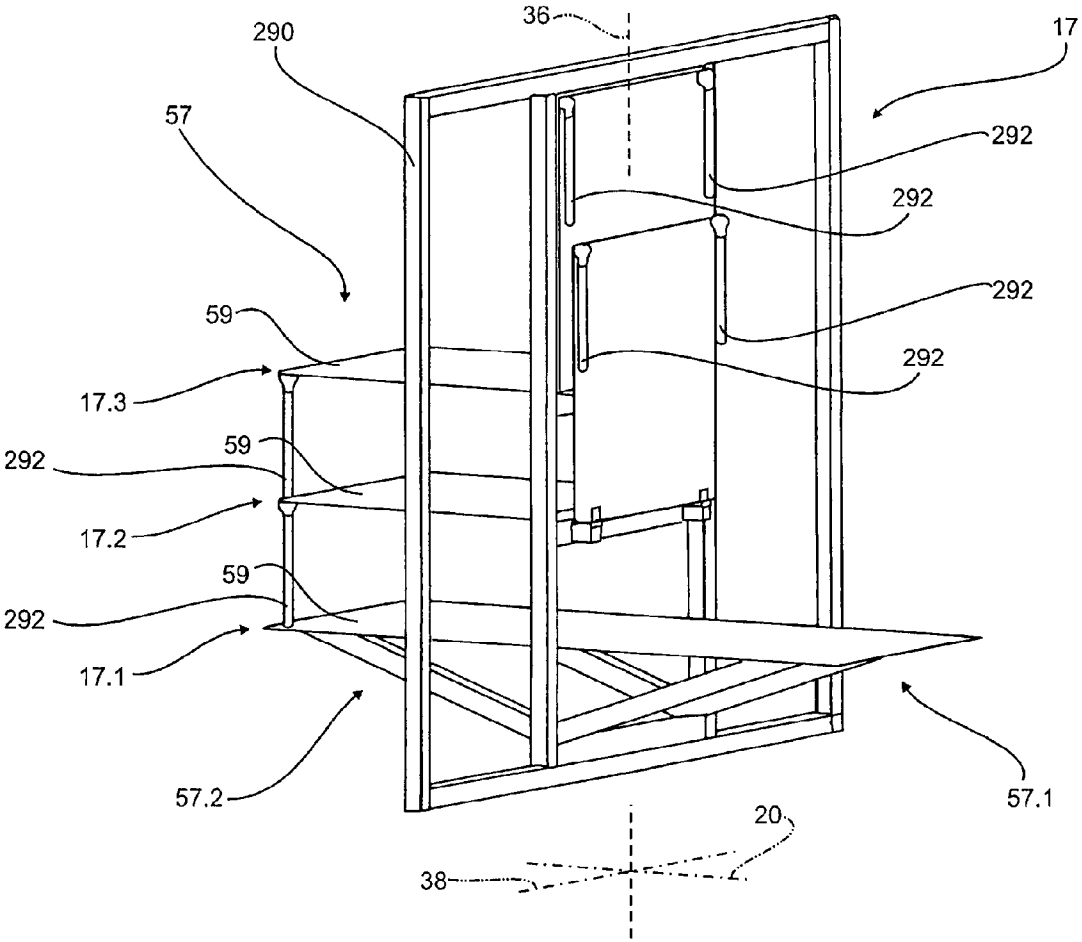
FIG. 33 The delivery unit with two hinged shelves.

FIGS. 32 and 33 show the delivery unit 17 in the first embodiment in a perspective representation. The delivery unit 17 has a magazine 57 to be filled with unfolded napkins. The magazine 57 of the delivery unit 17 is stored, as per FIGS. 31 to 35, preferably in a frame structure 290 configured to turn around a vertical axis 36 and/or move along an axis 20, 38. The magazine 57 has at least two units 57.1, 57.2 disposed side by side, each with multiple shelves 59 disposed on top of each other, whereby both geodetic underlying shelves 59 of the units 57.1, 57.2 preferably are configured as a solid, one-piece part.

The magazine 57 has at least two delivery levels 17.1 to 17.3, which are formed by the shelves 59 disposed opposite each other in pairs. Each shelf 59 can be used for holding a stack of unfolded napkins 12. In the foregoing exemplary embodiment, the magazine 57 has three delivery levels 17.1 to 17.3, whereby every two shelves 59 lie in one of the delivery levels 17.1 to 17.3. At least one part of the shelves 59 is hinged along the vertical axis 36 for loading or removing as per FIG. 33. In the foregoing exemplary embodiment, only the upper shelves 59 disposed in both delivery levels 17.2 and 17.3 are hinged. In the open state, the shelves 59 are rotatable in the frame structure 290 on one end, and on the other end are stored via pivoting or hinged corner supports 292, which are supported on the respective shelves 59 disposed thereunder. Preferably, the shelves 59 disposed in pairs in a delivery level 17.2 or 17.3 are rotatable on the inner ends, which are facing each other, and on the outer ends, which are facing away from each other, stored via the corner supports 292, so that the outer ends of the shelves 59 pivot inward when opening. When the shelves 59 are in the open state, the pivoting or hinged corner supports 292 lie flat on the shelves 59.

The delivery unit 17 is located in at least one delivery level 17.1 to 17.3 in a loading position and in at least one delivery level 17.1 to 17.3 in a removal position. In the operation of the napkin folding device, when the magazine 57 is fully loaded, the unfolded napkins 12 are first successively removed by one of the shelves 59 disposed in the delivery level 17.3 of the one unit 57.1. If the shelf 59 is empty, it will open upward so that the shelf 59 disposed underneath in delivery level 17.2 has access for further removal of unfolded napkins 12. If this shelf 59 is also empty, it will also open upward. In this way, the shelf 59 disposed underneath in delivery level 17.1 is emptied. Afterward, the magazine 57 is turned or moved so that the shelves 59 of the second unit 57.2 can be emptied in the same way. In the loading position, the magazine 57 or each shelf 59 of the delivery unit 17 can be refilled with napkins 12. In the foregoing exemplary embodiment, the shelves 59 of the magazine 57 can be loaded in all delivery levels 17.1 to 17.3 during the operation of the napkin folding device.

FIG. 31 shows the transport unit 19 in a fourth alternative embodiment. Here, the transport unit 19 has a grip unit 286 and folding stage unit 145. Preferably, the grip unit is configured as a robotic grip system, which has different working parts 286*a*, 286*b*. The drive of the grip system 286 can be hydraulic, mechanical, pneumatic, or electrical. In the foregoing exemplary embodiment, the grip system 286 is configured as a needle grip system 286*a* and/or a finger grip system 286*b*. The finger grip system can be one-finger, two-finger or multiple-finger grip systems in rigid, rigid-articulated, or elastic embodiments, whereby the grips are preferably fixed on one robotic arm, which make possible both rotational movements and linear movements of the grip system 286.

The folding stage unit 145 is configured as a table that is provided with a friction lining 288 and/or a vacuum device, not depicted here, for suctioning up the napkins 12, and/or a holding down device, likewise not depicted here. Preferably, the friction lining 288 in the folding stage unit 145, which is configured as a table, is designed to be stowed or lowered into this unit, so that the friction lining 288 can be deployed as necessary. The folding stage unit 145, which is configured as a table, fixes the napkin 12 during the folding process, for example, through the friction force exercised by the friction lining and/or light suction and/or holding down. In addition, a separation device, not depicted here, is provided, which can separate different layers of a folded napkin 12 or detach/lift them one from the other. The separation device is designed similarly to the holding down device. Here, the folding stage unit 145, which is configured as a table, serves not only to hold unfolded napkins 12, but also to accommodate and integrate fixing and separating devices.

During the operation of the napkin folding device, the transport unit 19 removes a napkin 12 from one of the stacks in the delivery unit 17 via the grip unit 286 and transports it onto the folding stage unit 145. Afterward, the napkin 12 can be processed by the folding unit 11.

FIG. 31 shows the folding unit 11 in a first alternative embodiment. Here, the folding unit 11 has a robotic grip system 241, which has different working parts. In the foregoing exemplary embodiment, the working part is designed as a 2-jaw-grip, the width of which is automatically or manually adjustable. The drive of the grip system 241 can be hydraulic, mechanical, pneumatic, or electrical. The working parts can consist of or comprise, for example, a one-finger, two-finger or multiple-finger grip, in rigid, rigid-articulated, or elastic embodiments, whereby the grips are preferably fixed on one robotic arm, which make possible both rotational movements and linear movements of the robotic arm of the grip.

Advantageously, the grip system 241 of the folding unit 11 works together with the finger grip system 286*b* of the transport unit 19. Thus, the finger grip system 286*b* of the transport unit 19 functions as supporting complementation to the grip system 241 of the folding unit 11.

Advantageously, the folding stage unit 145, which is configured as a table, and/or the folding unit 10, 11, and/or the grip unit 286 are designed as rotatable. Preferably, the table 145 and/or the folding unit 10, 11 and/or the grip unit 286 are in this way freely adjustable.

The napkins 12, which are folded on the folding stage unit 145, which is configured as a table, reach the folding unit 11 by means of the grip system 241 or an alternative conveyance unit in the storage unit 14, which might seem sensible to an expert.

Figure 34:
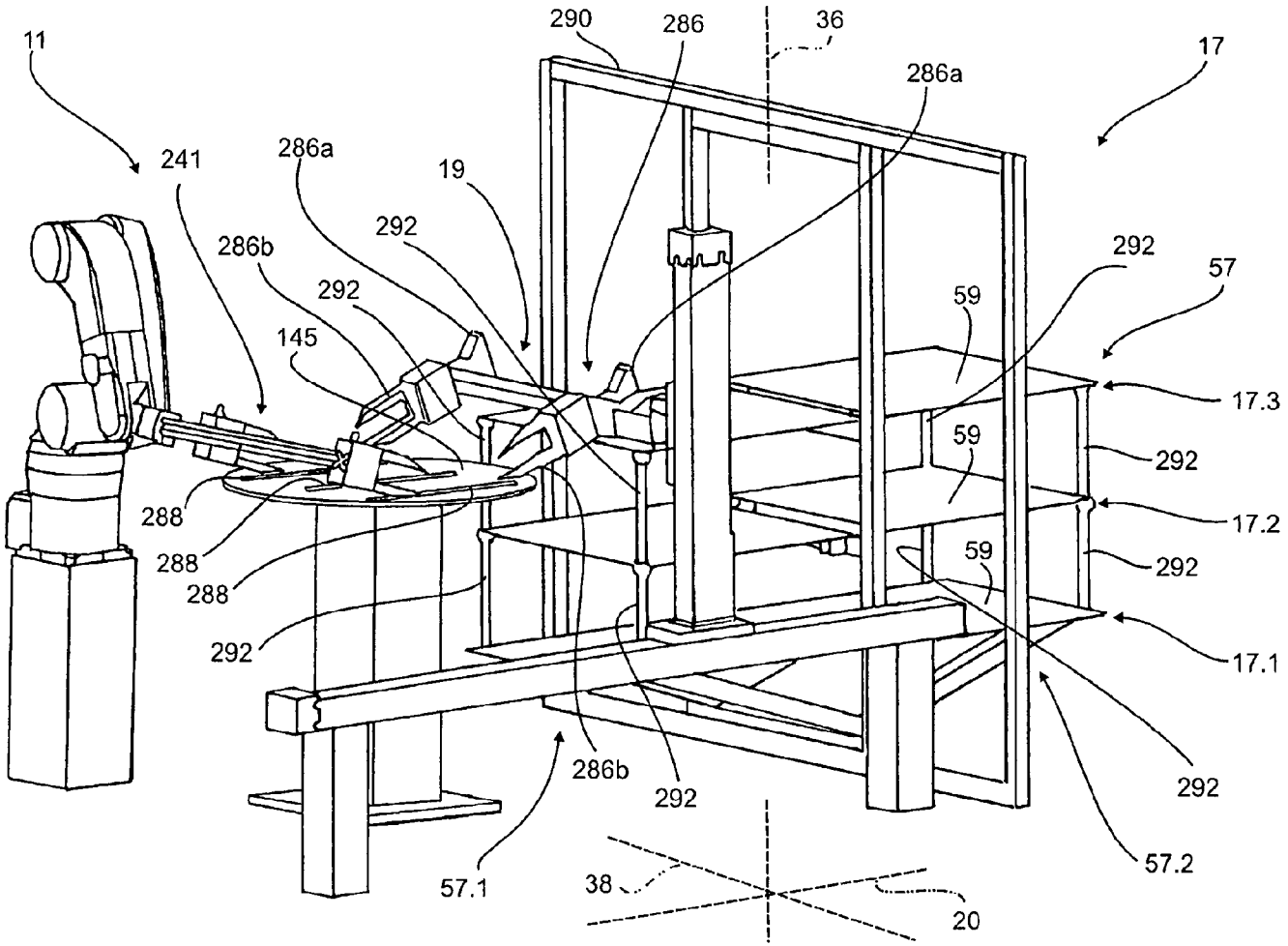
FIG. 34 The delivery unit in the first alternative embodiment, a transport unit in a fifth alternative embodiment, and the folding unit in the first alternative embodiment in a perspective representation of a partially displayed napkin folding device.

FIG. 34 shows the delivery unit 17 in the first alternative embodiment, a transport unit 19 in a fifth alternative embodiment, and the folding unit 11 in the first alternative embodiment in a perspective representation of a partially depicted napkin folding device. Here, the transport unit 19 is configured as a grip unit movable along an axis 20, 38.

Figure 35:
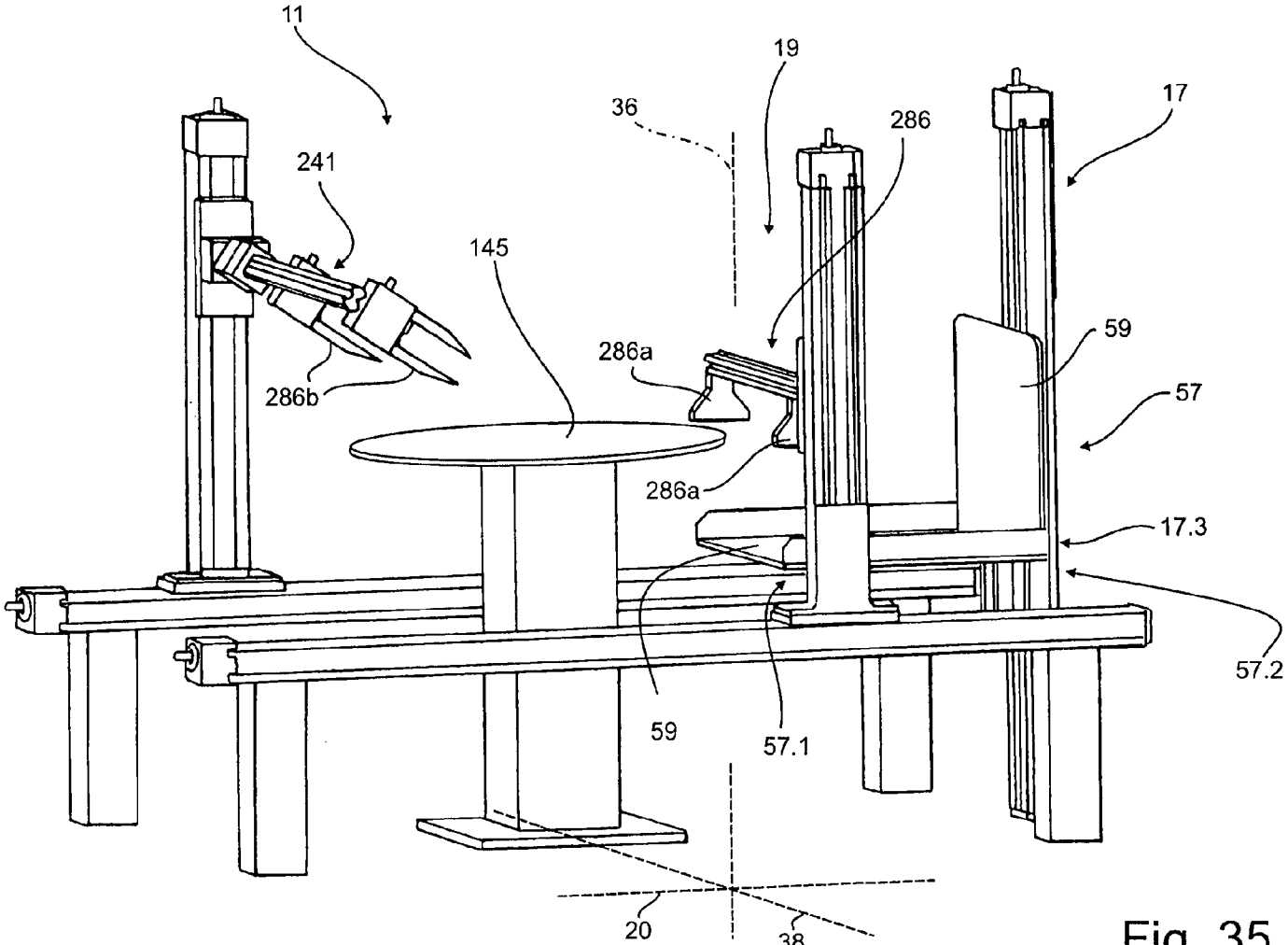
FIG. 35 A delivery unit in a second alternative embodiment, a transport unit in a fifth alternative embodiment, and the folding unit in the first alternative embodiment in a perspective representation of a partially displayed napkin folding device.

FIG. 35 [shows] a delivery unit in a second alternative embodiment, a transport unit in a fifth alternative embodiment, and the folding unit in the first alternative embodiment in a perspective representation of a partially depicted napkin folding device. Here, the folding unit 11 is configured as a robotic grip unit 241, which is movable along an axis 20, 38.

The napkin folding device has an inspection unit 294 as per FIG. 31, which is provided for detection of deviating values, whereby an expert can provide other inspection units. The at least one inspection unit 294 is disposed on the frame structure 290 of the delivery unit 17, but there are other conceivable arrangements of the inspection unit 294, which might seem sensible to an expert. The inspection unit 294 preferably consists of or comprises a camera with an image recognition system, which triggers an acoustic and/or optical alarm or stops the napkin folding device when a problem such as an incorrect or dirty napkin is discovered. In the foregoing exemplary embodiment, the inspection unit 294 should primarily detect the placement of the respective napkin 12 and, secondarily, certain problems such as tolerances, dirt, etc.

LIST OF REFERENCE NUMBERS

10 Folding unit
11 Folding unit
12 Napkin
14 Storage unit
16 Delivery unit
16.1-16.7 Delivery level
17 Delivery unit
17.1-17.3 Delivery level
18, 18', 18", 18'" Transport unit
19 Transport unit
20 Longitudinal axis
22 First tower (storage unit)
24 Second tower (delivery unit, transport unit, folding unit)
26 Housing
28 Door (delivery unit)
30 Door (folding unit)
32 Upper side (housing)
34 Edges
36 Vertical axis
38 Transverse axis
40 Side wall (delivery unit)
42 Side wall (delivery unit)
44 Rear wall (delivery unit)
46 Front (delivery unit)
48 Top (delivery unit)
50 Frame structure
52 Corner profile
54 Circular operation (54*a*, 54*b* components along the transverse axis; 54*c*, 54*d* components along the vertical axis)
56 Magazine
57 Magazine
57.1, 57.2 Units (magazine)
58 Shelf
59 Shelf
60 Guide rails
62 Guide rails
68 Handling unit
70 First handling device
72 Second handling device
74 Drive unit
76 Drive unit
78 Unit
80 Unit
82 Spindle (upper)
84 Drive wheel
86 Spindle (lower)
88 Drive wheel
90 Drive wheel
92 Axis
94 Axis
96 Belt (96*a* load strand, 96*b* empty strand)
98 Drive
100 Pressing unit
102 Drive device
104 Spindle (upper)
106 Drive wheel (upper)
108 Spindle (lower)
110 Drive wheel (lower)
112 Drive wheel (lower)
114 Axis
116 Axis
118 Belt (118*a* load strand, 118*b* empty strand)
120 Drive
122 Profile guideway
124 Pressing unit
126 Entry slot
128 First actuator unit (128*a*, 128*b* upper actuator, 128*c*, 128*d* lower actuator)
130 Second actuator unit (130*a* upper actuator, 130*b* lower actuator)
132 Fixing unit
138 Fixing actuators
140 Fixing actuators
142, 142', 142", 142'" Vacuum handling unit
144, 144', 144", 144'" Folding stage unit
145 Folding stage unit (table)
146 Separation unit
148 Spindle
150 Drive roll
152 Conveyor belt
154 Caster

156 Roll array
158 Roll
160 Circular direction (conveyor belt)
162 Area permeable to air
164 Area not permeable to air
166 Knobs
168 Drive
170 Cover profiles
172 Space (172*a* upper space, 172*b* lower space)
174 Sealing unit
176 Pressure generating unit
178 Hose
180 Sensor unit
182, 182', 182", 182'" Folding stage (182*a*', 182*b*' folding stage part)
184 Frame element
186 Bore array
188 Slot
190 Slot (190*a* slot, 190*b* slot)
192 Holding element
194 Space
196 Hose
198 Removal slot
200 Guide channel
202 Inner guide channel
204 Outer guide channel
206 Separating point
208 Belt drive
210 Spindle (upper)
212 Spindle (lower)
214 Drive wheel (upper)
216 Drive wheel (lower)
218 Belt (218*a* load strand)
220 Drive
222 Guide surfaces
224, 224', 224", 224'" Carrier framework (224*a*' carrier framework part, 224*b*' carrier framework part)
226, 226', 226", 226'" Suction element
228 Rod (228*a*' rod, 228*b*' rod)
230 Joint (230*a*' joint, 230*b*' joint)
232" Rail system
234'" Axis
238 Front
240 Grip system
241 Grip system
242 Grip (working part)
244 Geometric body (working part)
246 Holding element (working part)
248 Supporting element (working part)
250 Arm
252 Panel
254 Guide system
256 Hinged element
258 Sliding element
260 Side
262 Side
264 Rear wall
266 Front
268 Top
270 Gantry
272 Shaft
274 Shaft
276 Lower area
278 Upper area
280 Cartridges
282 Drawers (282*a* base, 282*b*, 282*c* side part)
284 Recess
286 Grip unit (transport unit 19)
286*a* Needle grip system
286*b* Finger grip system
288 Friction lining
290 Frame structure
292 Supports
294 Inspection unit

The invention claimed is:

1. A napkin folding device comprising a folding unit which is provided to fold individual napkins, a storage unit which is provided to hold the folded napkins from the folding unit, a delivery unit which is provided to hold unfolded napkins, and a transport unit which is provided to feed the unfolded napkins from the delivery unit to the folding unit, wherein the delivery unit has a magazine with at least two delivery levels;

wherein the magazine comprises a plurality of discrete shelves which circulate along a common closed loop path, the plurality of shelves for conveying unfolded napkins, the magazine being configured so that multiple shelves among the plurality of shelves are positioned at respective discrete levels among the at least two delivery levels and concurrently carry napkins;

wherein the closed loop path is a first closed loop path;

wherein the magazine further comprises comprises a plurality of pairs of guide rails which move along a second closed loop path;

wherein each one guide rail pair among the plurality of guide rail pairs circulates along said second closed loop path from respective first positions for each one guide rail of said one guide rail pair at which a first shelf of said plurality of shelves is supported at a lowest level in the magazine, to respective second positions at which the first shelf is supported at a highest level in the magazine, to respective third positions at said highest level in the magazine at which the first shelf is no longer supported, to respective fourth positions at said lowest level in the magazine at which the first shelf is not supported, and back to the respective first positions where one shelf of either the first shelf or another shelf of the plurality of shelves is supported at the lowest level in the magazine;

wherein each one shelf among the plurality of shelves circulates along the first closed loop path from the lowest level in the magazine to the highest level in the magazine while being supported by a supporting pair of guide rails among the plurality of guide rails, then moves off the supporting pair and circulates back to the lowest level in the magazine where said one shelf moves onto a same or another supporting guide rail pair among the plurality of guide rail pairs, wherein said first positions differ from said fourth positions and said second positions differ from said third positions;

wherein the delivery unit comprises a first conveying device for moving the guide rails pairs in the delivery unit and a second conveying device for moving the shelves in the delivery unit; and wherein the second conveying device moves said each one shelf from the highest level in the magazine back to the lowest level in the magazine.

2. A napkin folding device according to claim 1, wherein at least some of the shelves are able to tilt in a direction of a vertical axis.

3. The napkin folding device according to claim 1, wherein the delivery unit further comprises a profile guideway extending along a vertical axis of the magazine, and an entry slot at said highest level of the magazine through which said one shelf is moved onto the profile guideway where an orientation of said one shelf changes from a profile for supporting napkins to a different profile for being conveyed back to the lowest level.

4. The napkin folding device according to claim 3, wherein the delivery unit further comprises an actuator for moving said one shelf transversely while at the highest level supported by said one guide rail pair off said one guide rail pair through said entry slot where said second conveying device can move said one shelf along the profile guideway back to said lowest level.

* * * * *